US005241290A

United States Patent [19]

Sehmer et al.

[11] Patent Number: 5,241,290

[45] Date of Patent: Aug. 31, 1993

[54] COMPACT CIRCUIT BREAKER

[75] Inventors: Robert W. Sehmer; James T. Tucker, both of Knightdale, N.C.

[73] Assignee: Square D Company, Palatine, Ill.

[21] Appl. No.: 811,405

[22] Filed: Dec. 20, 1991

[51] Int. Cl.[5] ..... H01H 9/02

[52] U.S. Cl. ..... 335/202; 335/185; 335/132

[58] Field of Search ..... 335/6, 202, 167-176, 335/183-190, 132

[56] References Cited

U.S. PATENT DOCUMENTS 3,772,620 11/1973 Harris ..... 335/190

3,851,284 11/1974 Yoshino et al. ..... 335/21

*Primary Examiner*—Lincoln Donovan

*Attorney, Agent, or Firm*—Larry I. Golden; David Russell Stacey

[57] ABSTRACT

The low dissipation compact circuit breaker of the present invention selectively conducts breaker current in a circuit to be protected. The compact circuit breaker is in an enclosure surrounding at least a stationary contact and a moveable contact. This moving contact selectively assumes one of two bistable states, a contiguous closed state or a noncontiguous open state. A rotary operator including rotary members and a contact lever train selectively causes the stationary contact and the moveable contact to assume either a closed or an open state. A single solenoid for sensing breaker current in each phase causes the rotary operator to move the contacts from a closed state to an open state. Additionally, the solenoid for a faulted phase directly acts on a solenoid bell crank to cause the contact to begin to assume an open state in a trip operation, if breaker current reaches a preselected trip value in the faulted phase. The rotary operator causes all contacts to move from a closed to an open position by initiating a trip operation in the contact lever trains.

54 Claims, 23 Drawing Sheets

COMPACT CIRCUIT BREAKER

NATURE OF THE INVENTION

This invention relates to the field of protective devices particularly current limiting magnetic circuit breakers and most particularly for the magnetic circuit breaker component for a motor control center including a contactor and a thermal circuit breaker.

BACKGROUND OF THE INVENTION

Circuit breakers as such have long been known either as discrete components or as a portion of an integrated motor controller. A magnetic circuit breaker must interrupt a fault current and dissipate the heat generated during the interruption process. A current limiting magnetic circuit breaker limits current by interrupting the fault current before it can fully develop. The heat dissipation requirements can require larger circuit breakers for the ability to absorb and dissipate heat. The amount of heat generated is generally proportional to the duration of any arc generated during the interruption process and the amount of current carried in that arc. Among the patents issued in this area is U.S. Pat. No. 4,118,608 issued to Frank W. Kussy et al on Oct. 3, 1978 describing a TRIP INDICATOR. Frank W. Kussy has alone and with others, a number of patents published in this area of technology. Also known are protective devices involving rotary action of a knob to activate an on or off operation such as that believed to be sold by Telemecanique, under their INTEGRAL 32 name, controls circuit continuity with holding contacts. Also publicly used is the Klockner-Moeller Model PKZ-2, which is believed to have a rotary acting mechanism with high speed current sensing solenoids with direct actions on the contacts. This breaker uses a gear driven spring loaded over center mechanism. Additional improvement is desirable in the circuit breaker area to reduce the time of interruption and the amount of heat that is generated during the interrupting process. Low dissipation in a breaker allows compactness.

SUMMARY OF THE INVENTION

The low dissipation compact circuit breaker of the present invention selectively conducts breaker current in a circuit to be protected. The compact circuit breaker is in an enclosure surrounding at least a stationary contact and a moveable contact. This moving contact selectively assumes one of two bistable states, a contiguous closed state or a noncontiguous open state. A rotary operator means selectively causes the stationary contact and the moveable contact to assume either a closed or an open state. Sensing trip means for sensing breaker current causes the rotary operator means to move the contacts from a closed state to an open state. Additionally, the sensing trip means directly acts to cause contacts to begin to assume an open state in a trip operation, if breaker current reaches a preselected trip value in the faulted phase. The rotary operator means causes the contacts to move from a closed to an open position by initiating a trip operation.

BRIEF DESCRIPTION OF THE DRAWING

FIG. 32-B is a perspective view of a moving contact carrier component of the switch of FIG. 31.

DETAILED DESCRIPTION OF THE DRAWING

Figure 1:
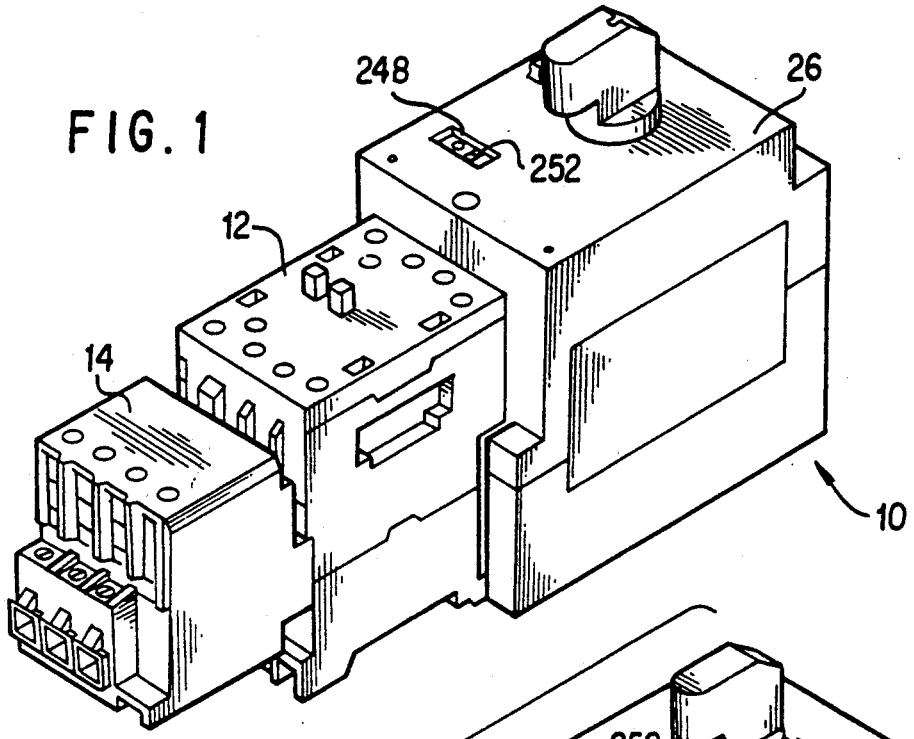
FIG. 1 is a non-integrated protective mechanism for a motor starter including the low dissipation compact circuit breaker of the present invention.

FIG. 1 illustrates the compact circuit breaker 10 (FIG. 1) of the present invention in association with customarily associated units being a contactor 12 (FIG. 1) thermal circuit breaker 14 (FIG. 1). Circuit breaker 10 of the present invention is a magnetic circuit breaker designed to interrupt faults in the circuit including the breaker of moderate value exceeding a preselected trip value. Contactor 12 is typically used as a remote operated switch to turn an associated protected motor on and off. Thermal circuit breaker 14 is intended to interrupt low level faults.

Figure 2:
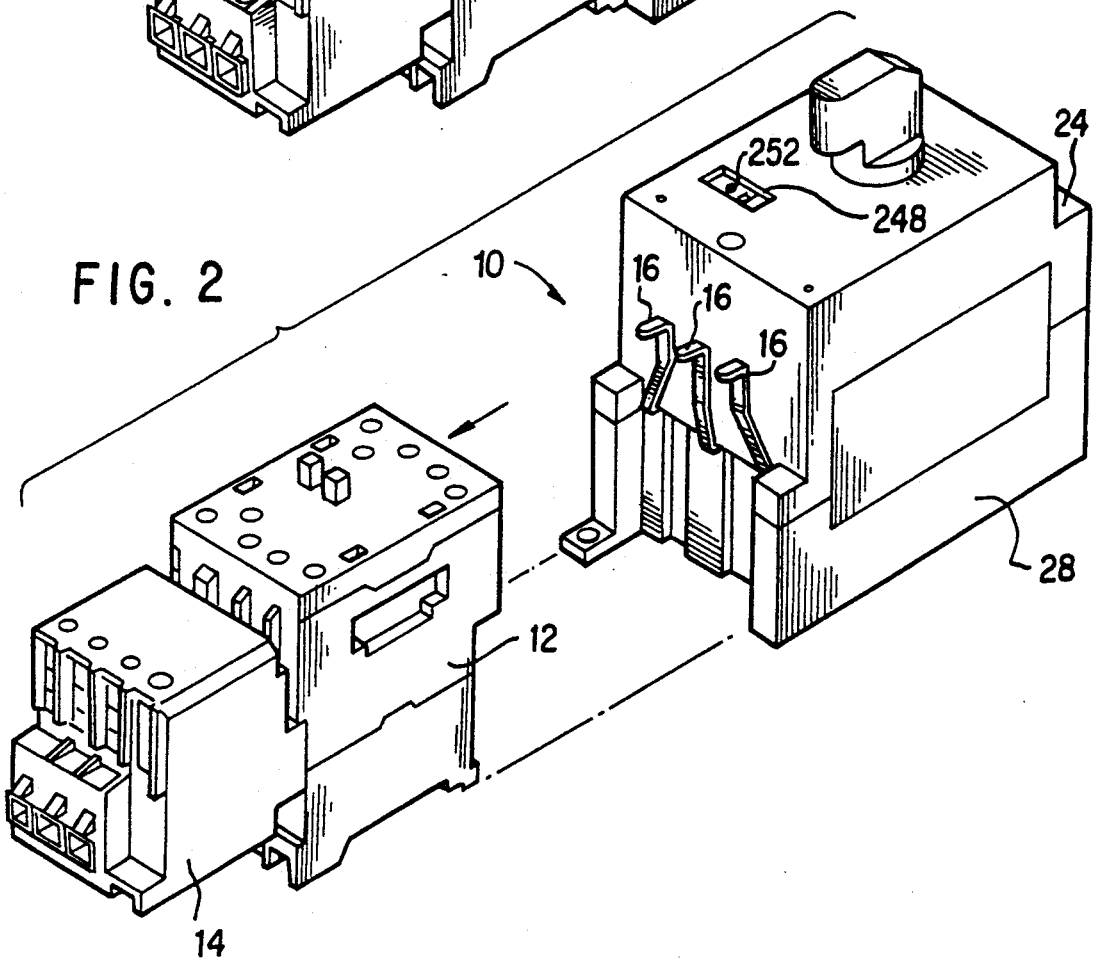
FIG. 2 is a perspective view of the motor starter circuit of FIG. 1 with the compact circuit breaker of the present invention separated from the remaining components.

FIG. 2 shows circuit breaker 10 in isolation from associated components, contactor 12 and thermal breaker 14 and particularly shows stabs 16 (FIG. 2) particularly configured to join a particular breaker 10 to a particular contactor 12. Stabs or tangs 16 come in a number of particular configurations to insure that circuit breaker 10 and contactor 12 are a suitable match. Contactor 12 comes in a variety of current ratings and only those current ratings suitable for use with a particular circuit breaker 10 can be used with circuit breaker 10 because of the stabs 16 configuration since a stabs 16 are spaced to fit only one current rating of a family of potential contactors.

Figure 4:
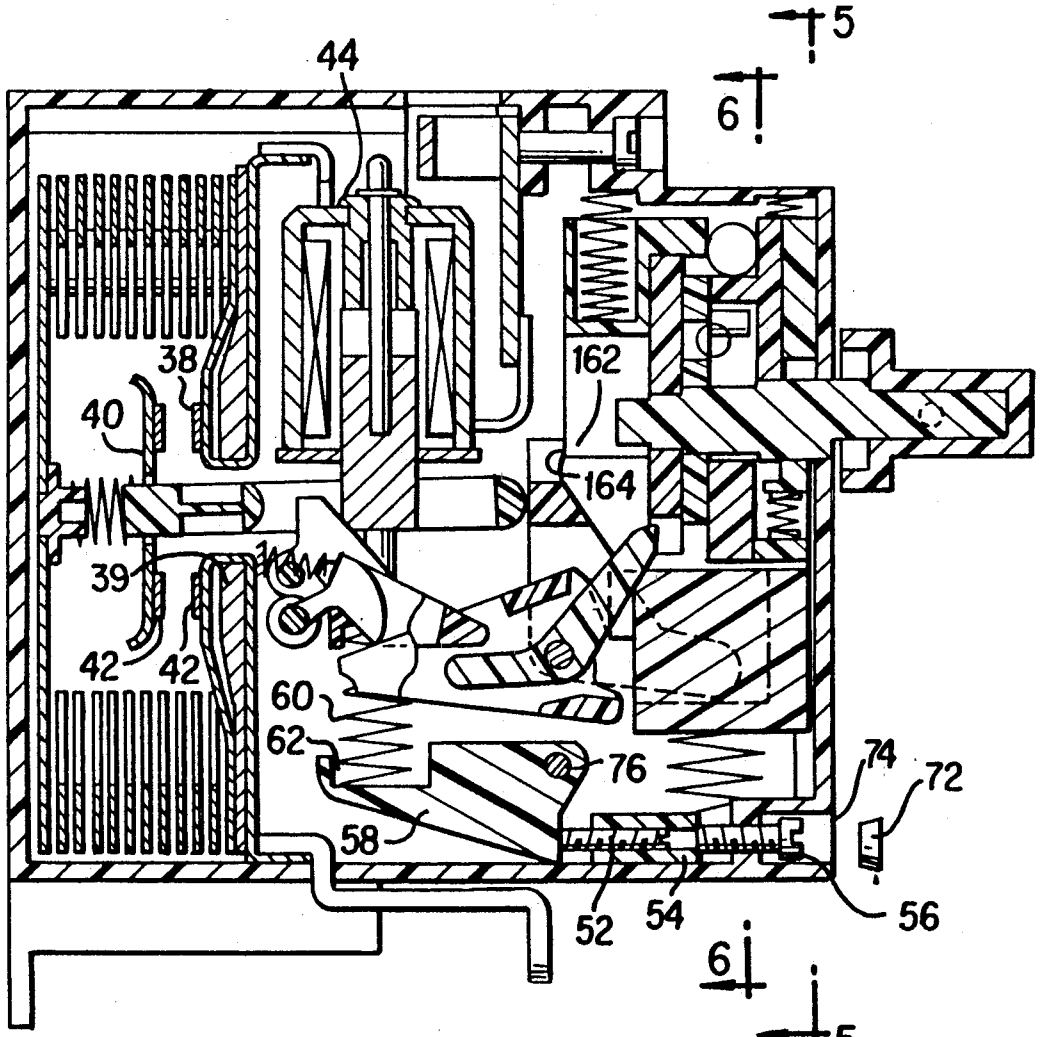
FIG. 4 is a sectional view along the lines 4—4 of FIG. 3.
Figure 16:
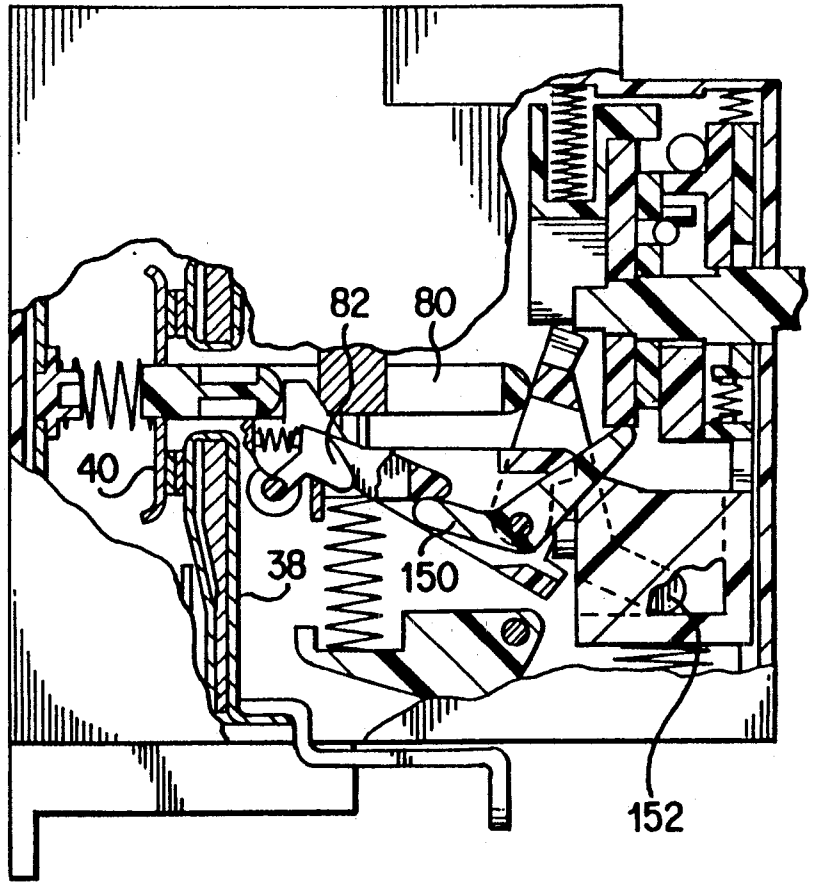
FIG. 16 is a cross section view of the compact circuit breaker of FIG. 14 along the lines 16—16.

Line terminals 18 (FIG. 23) include a conventional planar tab 20 (FIG. 23) which has an unconventional side notch 22 (FIG. 23) interfacing with a portion of enclosure 24 to prevent inadvertent withdrawal of line terminal 18 in the process of connecting conductors to the line side of breaker 10. Enclosure 24 (FIG. 2) includes top housing 26 (FIG. 1), bottom housing 28 (FIG. 2) and middle housings #1-4, 30-36 housing components #1, #2, #3, and #4 reference numerals 30, 32, 34, and 36 (FIG. 23) respectively. The enclosure outside surfaces are top housing 26, bottom housing 28 middle housing component #1 reference numeral 30 and middle housing component #4 reference numeral 36. Notches 22 engage associated portions of middle housing components 30, 32 and 34. Between load terminal stabs 16 and line terminal 18 are a pair of contacts for each phase, namely a stationary contact 38 (FIGS. 4, 16) and a moveable contact 40 (FIG. 16) each having a pair of (FIG. 4). Magnetic enhancers 39 (FIG. 4) may be used in stationary contacts 38. A contiguous closed state for contacts 38,40 is shown in FIG. 16. Similarly, a noncontiguous open state between contacts 38,40 is shown in FIG. 4. A single trip solenoid 44 (FIG. 23) senses current in a respective phase and initiates a trip operation when the current in the phase exceeds a preselected trip value of the breaker current whether the breaker current exceeds the trip value by a large margin or by a lesser margin.

Figure 23:
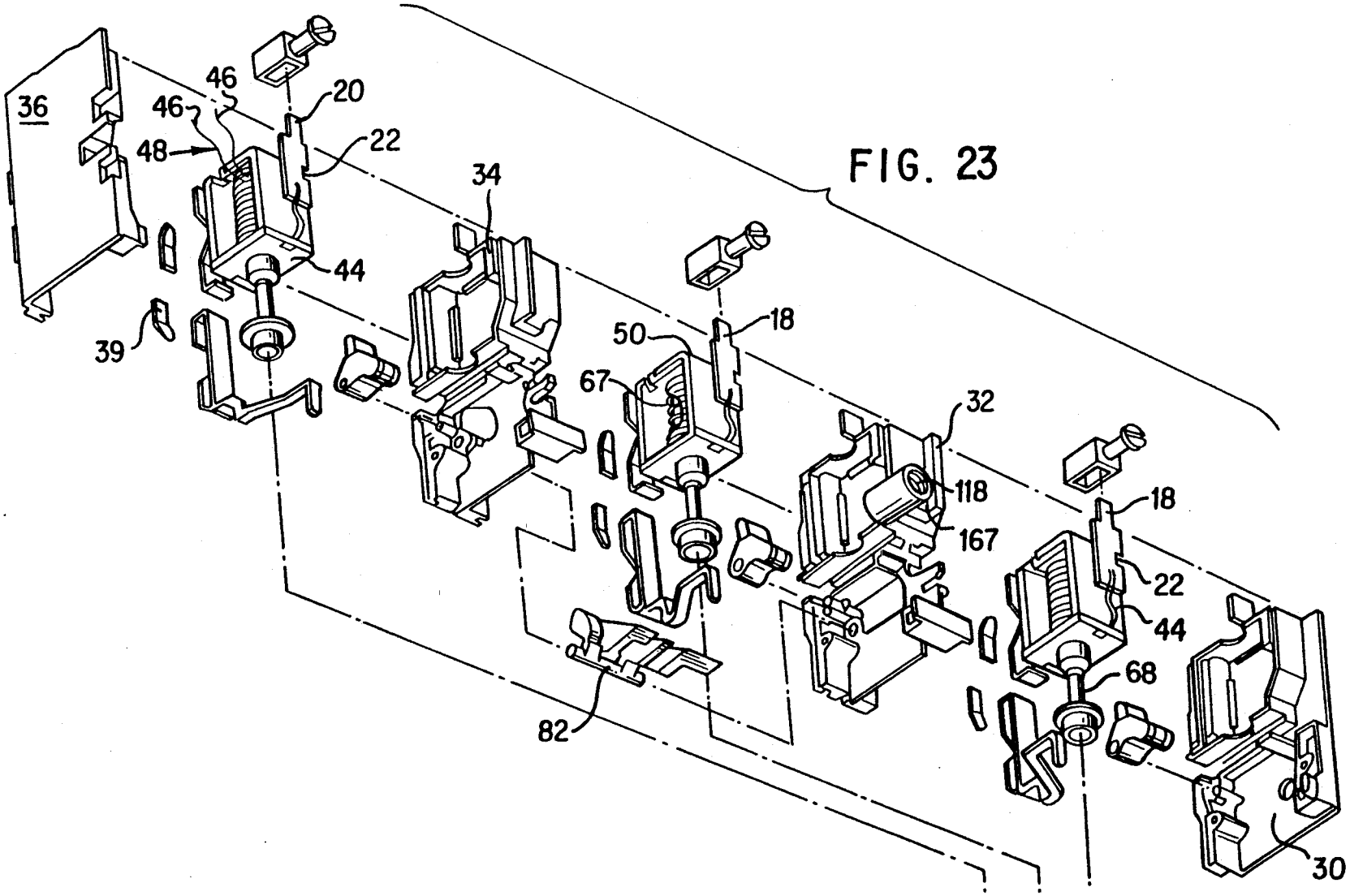
FIG. 23 is a exploded view of the solenoid components of the present invention along with components associated with the solenoids.

Solenoids in some ranges of trip current values may be advantageously double wound with a bifilar winding 46 (FIG. 23) to minimize winding diameter which is illustrated in FIG. 23. Free end 48 (FIG. 23) of the winding for solenoid 44 (FIGS. 4, 23) is connected to stationary contacts 38. The opposite end of the winding for solenoid 44 is connected line terminal 18. Nuisance trips about a trip value may be a problem with some motors. To reduce the number of nuisance trips, solenoid frame 50 (FIG. 23) is of a non uniform cross section to cause saturation near the trip value of the breaker. Finite element analysis may be used to determine appropriate frame dimensions to cause saturation, typically, about 10 times full load motor current. In the event that saturation is not achievable, a typical inertial delay may be inserted, as is well known to those skilled in the art. The trip value for each solenoid 44 is individually adjustable at the factory with individual trip value screw 52 (FIG. 4). Individual trip value screw 52 passes through trip adjustment beam 54 (FIG. 4) in an individual orifice. A user of circuit breaker 10 may adjust a central beam adjustment screw 56 (FIG. 4) which adjusts the beam so that all individual trip values are changed to another common value. Each individual trip screw 52 bears against a respective trip adjustment lever 58 (FIG. 4) to adjust the degree of preload through adjustment spring 60 (FIG. 4).

Figure 20:
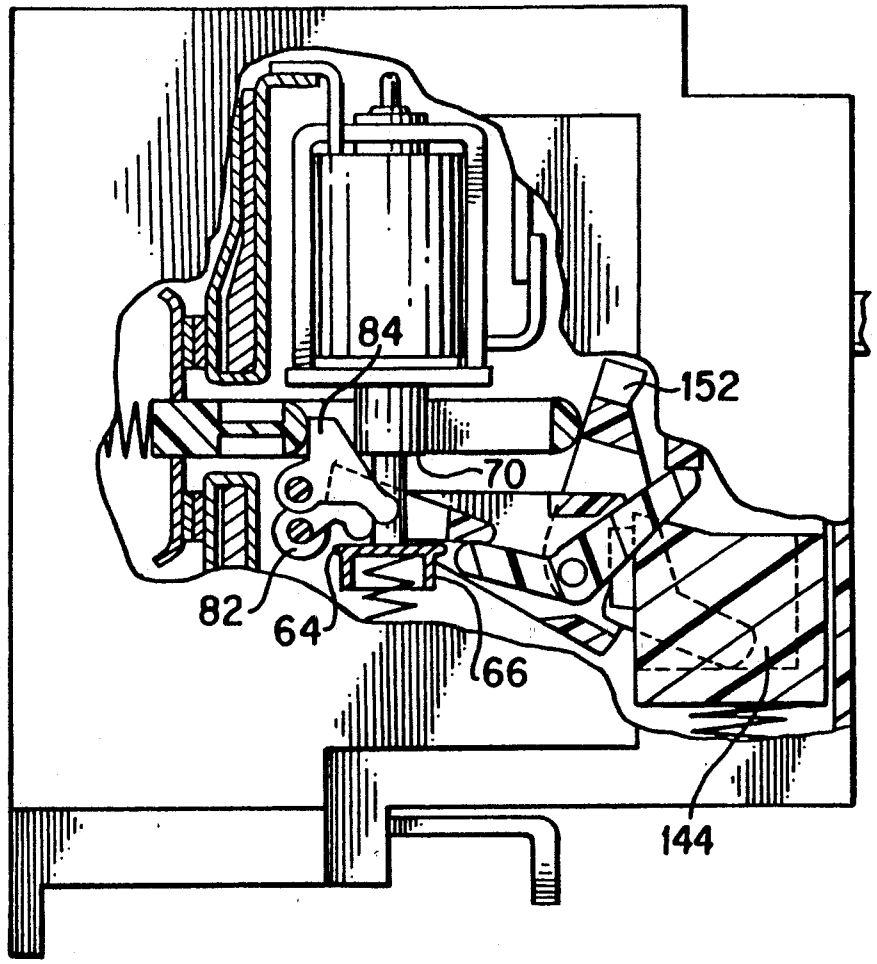
FIG. 20 is a similar view showing a portion of the internal mechanism of the compact circuit breaker when the contacts are in an on position.

Adjustment spring 60 extends between spring cup 62 (FIG. 4) in trip adjustment lever 58 to brim 64 (FIG. 20) surrounding the upper circumference of plunger hat 66 (FIG. 20). A conventional solenoid return spring 67 (FIG. 23) totally contained within the body acts in opposition to the adjustment spring 60. Activation of solenoid 44 by a trip current causes the hat 66 to move towards the plunger frame 50 which causes brim 64 to interact with a contact lever and move the contacts to an open position in a trip operation. Brim hat 66 and brim 64 are withdrawn towards solenoid frame 50 by means of solenoid shaft 68 (FIG. 23) passing through a shaft orifice 70 (FIG. 20) and solenoid frame 50. Magnet sticking forces and friction between solenoid shaft 68 and solenoid frame 50 can be reduced by making shaft orifice 70 with a plurality of dimples about the circumference of shaft orifice 70. As conveniently seen in FIG. 4 and 15, minimum penetration of individual trip screws 52 into trip adjustment beam 54 will result in a maximum current setting for breaker 10, if trip adjustment beam 54 is distant from trip adjustment lever 58. Tamper plug 72 (FIG. 4) may be used to block access to beam adjustment screw 56 and once removed cannot be replaced indicating that an attempt has been made to change the setting of breaker 10.) Attempts to remove tamper plug 72 from access hole 74 (FIG. 4) results in sufficient distortion of tamper plug 72 to prevent its replacement. Each trip adjustment lever 58 is pivotally supported by a pivot shaft 76 (FIG. 24) near the apex of the triangular adjustment lever 58 above an angled adjustment face 78 (FIG. 24) distant from said spring cup 62. Individual trip screws 52 in cooperation with trip adjustment levers 58 and trip adjustment beam 54 act as individual adjustable trip level means for individually varying the trip level of a given phase. Cooperatively the individual adjustment trip level means for all phases with beam adjustment screw 56 act as circuit breaker adjustable trip level means for simultaneously varying the trip level of each trip solenoid to set a common trip level for the breaker.

Moving contacts 40 are each guided on an individual contact carrier 80 (FIG. 16). As a fault on a phase occurs brim 64 impacts against contact lever train member trigger 82 (FIGS, 16, 20), initiating a trip operation through the remainder of contact lever train. Shortly thereafter, brim 64 impacts against solenoid bell crank 84 (FIG. 20), causing bell crank 84 to directly act on the faulted contact carrier 80. The rotary operation means is then allowed to open the contact. Sensing trip means for sensing breaker current, causing the rotary operation means to move the contact from a closed state to an open state and for directly acting to cause the contacts to begin to assume the open state in a trip operation when the breaker current reaches a preselected trip value is provided by the cooperation of a number of elements. These cooperating elements include solenoid 44 and its components contact carrier 80, trigger 82 and solenoid bell crank 84.

Figure 14:
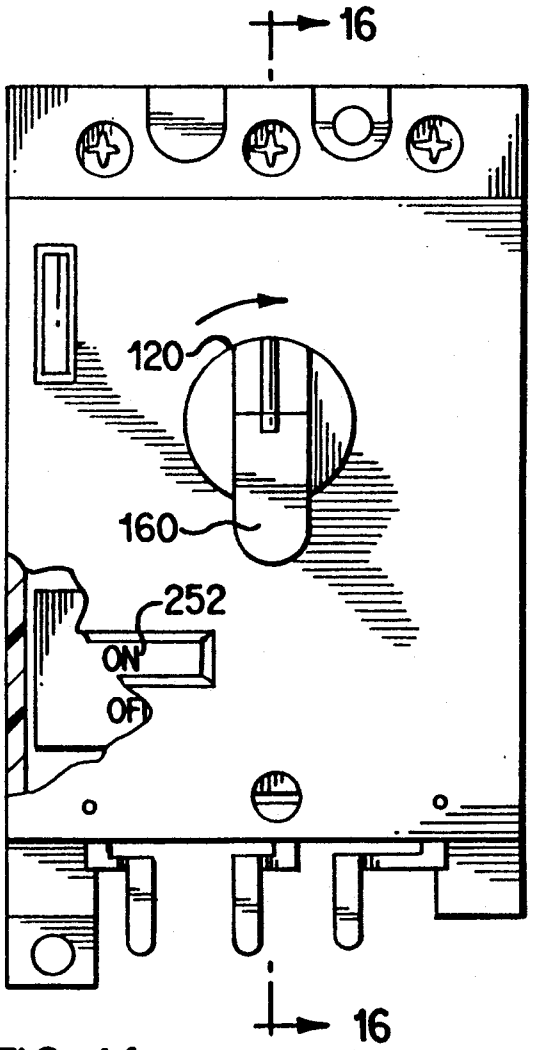
FIG. 14 is a front elevation of the compact circuit breaker illustrating the very last portion of movement to bring the contacts into the on position.
Figure 13:
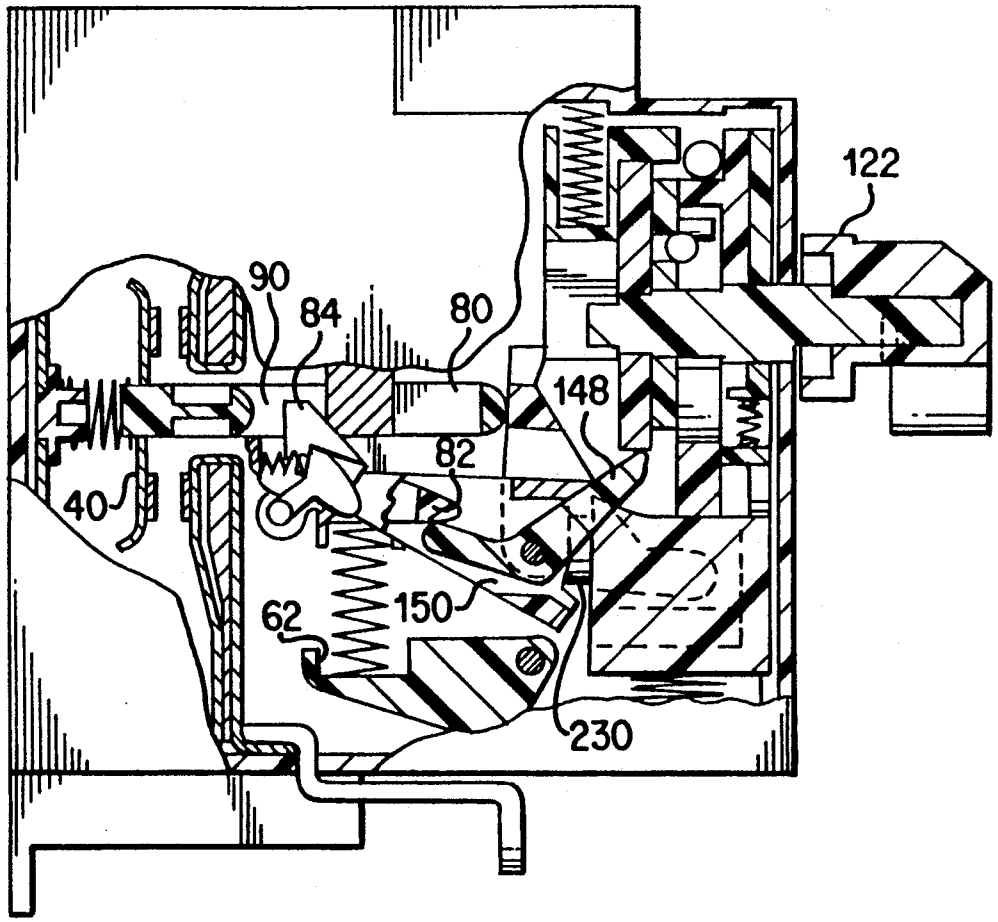
FIG. 13 is a side elevation of the compact circuit breaker of FIG. 9 with the enclosure partially broken away.
Figure 24:
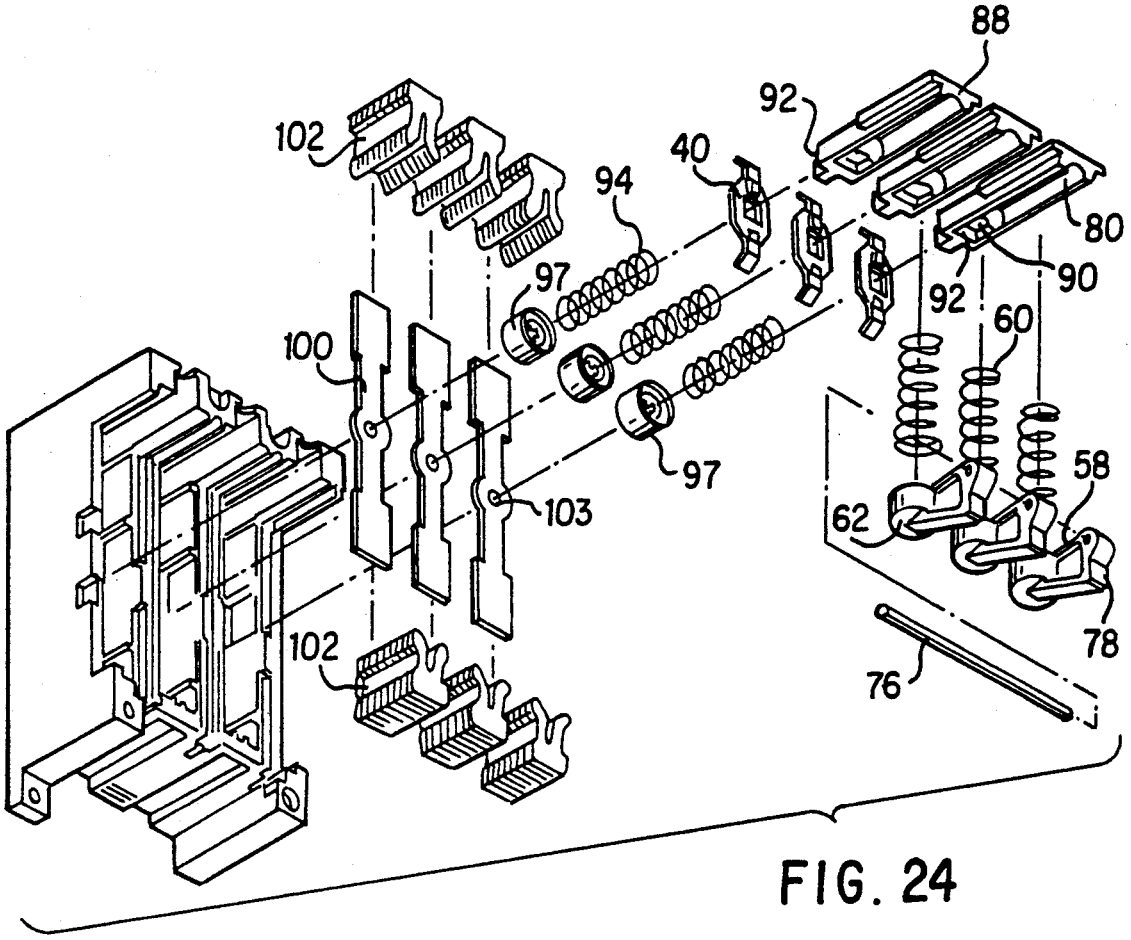
FIG. 24 is an exploded view continued from FIG. 23 showing components of the compact circuit breaker more closely associated with the contacts.
Figure 25:
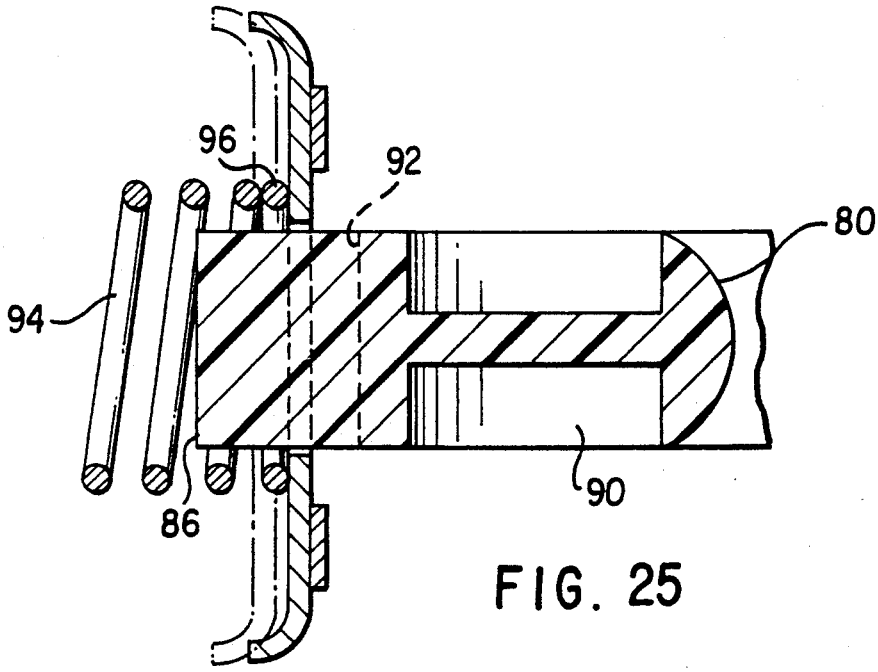
FIG. 25 is a cross sectional view of a moving contact and components most closely associated with the moving component.
Figure 26:
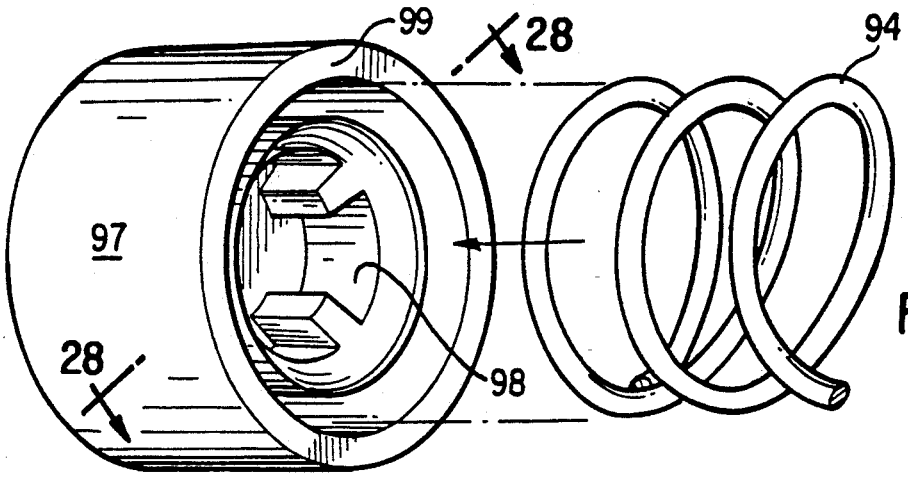
FIG. 26 is a perspective view of a contact mounting spring and its spring seat.
Figure 27:
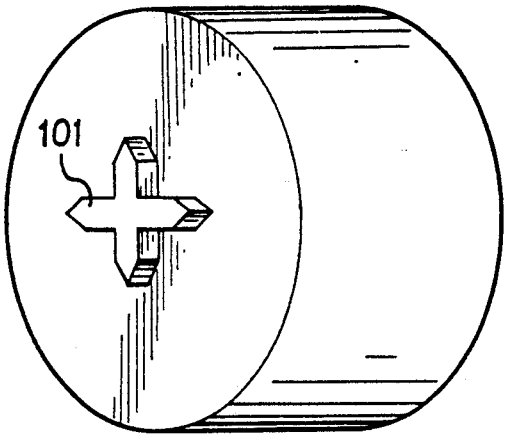
FIG. 27 is a perspective view of the spring seat of FIG. 26 from a bottom perspective.
Figure 29:
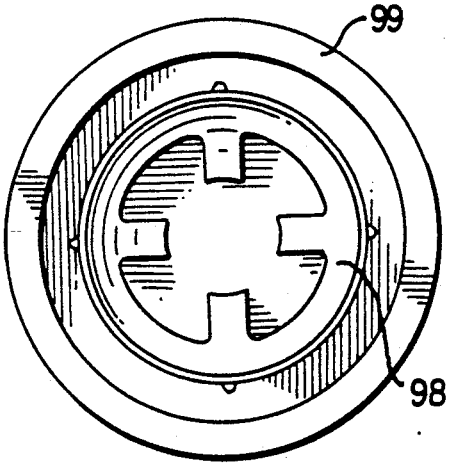
FIG. 29 is a top plan view of the spring seat of FIG. 26.
Figure 28:
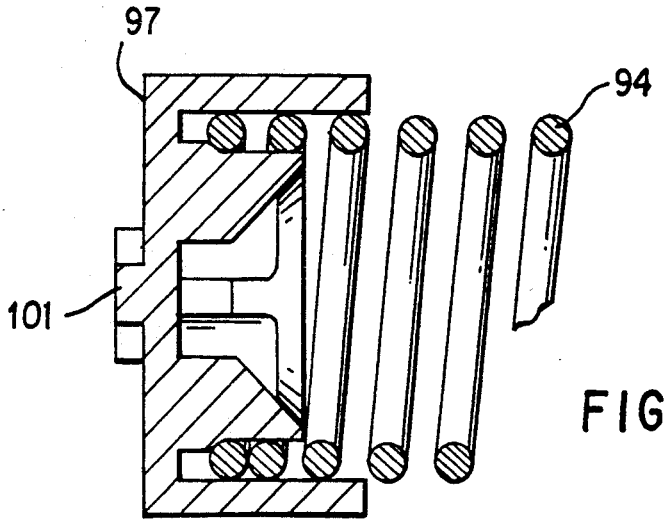
FIG. 28 is a cross sectional view along the line 28—28 of FIG. 26.

Although the faulted phase initiates movement to open all the contacts through trigger 82, solenoid bell crank 84 by having lower inertia and directly acting on the associated contact carrier acts to open the faulted contact phase first. Thereafter, the remaining contacts are opened by the trigger 84 initiated movement. Depending upon the level of fault, the contact for the faulted phase may be already open due to magnetic forces by the time bell crank 84 initiates movement by the associated contact carrier. The magnetic forces are generated by a convoluted current path between moveable contact 40 and stationary contact 38. Contact carriers 80 include a chisel point end 86 (FIG. 25), a bell crank end 88 (FIGS. 19, 24) and a solenoid bell crank indentation 90 (FIGS. 13, 14) adjacent chisel point end 86. Moveable contact 40 is slidingly fitted onto chisel point end 86 and is retained in place by being trapped against contact shoulder 92 (FIG. 24) and contact spring 94. Contact spring 94 (FIG. 24) fits about chisel point end 86. At an opposite skirted contact spring end 96 (FIG. 25), spring end 96 is received by spring seat 97 (FIG. 24) mounted on shorting strap 100 (FIG. 24) with a locating cross 101 (FIGS. 27, 28). Strap 100 runs between arc quencher stacks 102 (FIG. 24) to maintain an equal potential. Locating cross arms 101 are a snuggish fit in strap hole 103 (FIG. 24). When the moving contacts 40 are fully open spring 94 is shielded from arc debris such as hot metal particles. Spring end 96 surrounds hollow reinforced post 98 (FIG. 29) and skirt 99 (FIG. 29) surrounds both spring end 96 and post 98. The open top of spring seats 97 is covered by contact 40 when contact 40 is fully open. Spring seats 97 are a shock absorbing material such as ZYTEL 101 and tend to cushion the impact of contact carriers 80 under high fault conditions. Ablation of the glass reinforced NYLON in the quencher area promotes arc cooling and more rapid interruption. It is desirable that moveable contact 40 not have a mass substantially in excess of contact carriers 80 to avoid the eventuality of moving contacts 40 rebounding from fully compressed spring 94 and substantially impeding the downward movement of contact carrier 80.

Figure 12:
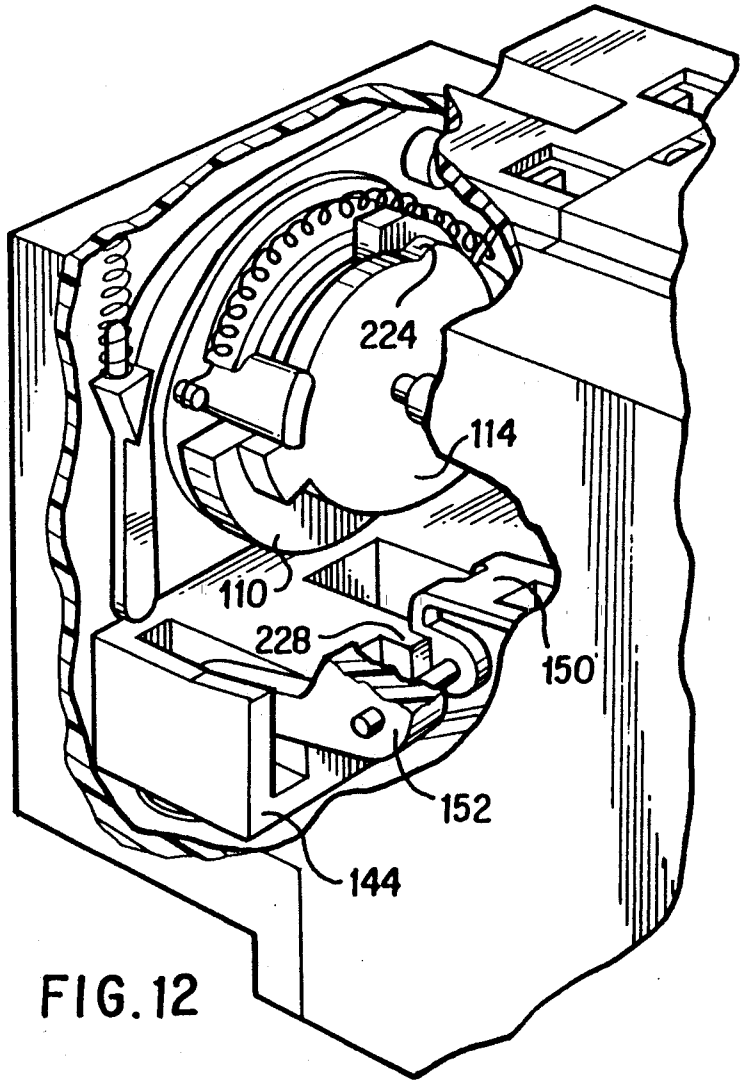
FIG. 12 is a perspective view of the compact circuit breaker with the enclosure partially removed as is FIG. 7.
Figure 11:
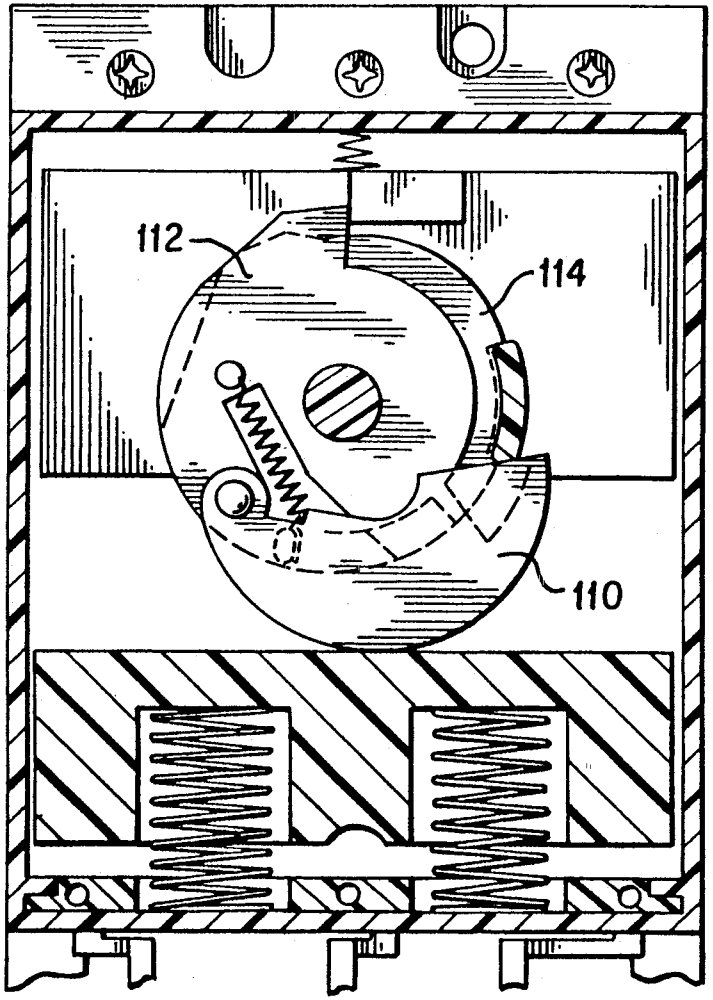
FIG. 11 is a cross section view of FIG. 9 in the manner of FIG. 6.
Figure 22A:
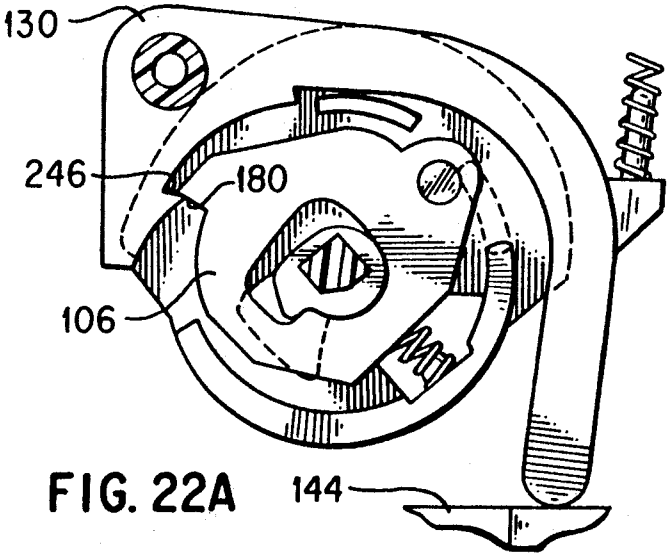
FIG. 22A is a view of the internal mechanism illustrated in FIG. 18A showing that mechanism towards the end of a trip operation.
Figure 22B:
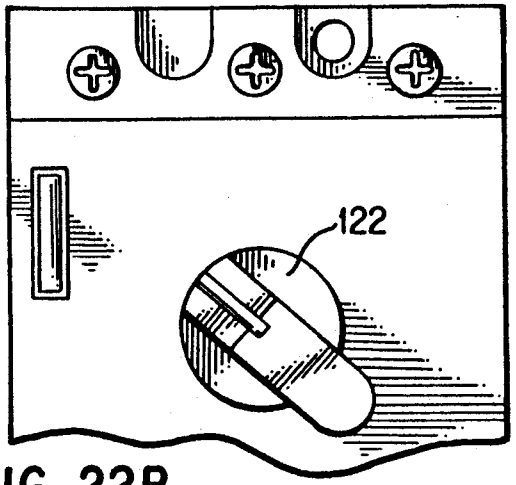
FIG. 22B is a partial view of the front of the compact circuit breaker of the invention showing the knob reflecting a trip operation.

The low dissipation circuit breaker 10 of the invention achieves low dissipation with a variety of techniques. Among those techniques is the rotary operating means generally rotating about operator shaft 104 (FIGS. 5, 8) in a first direction or plurality of parallel axis and a contact lever train operating in a second direction or second plurality of parallel planes. Additionally, a number of miscellaneous members generally reciprocate in interacting with the shaft rotary members or contact lever train members. A significant portion of the speed with which contacts 40 move to the open position results from the low inertia of the moving members. The manner in which the shaft rotary members and the contact lever train interact further contribute to the speed and compactness of breaker 10. The plurality of shaft rotary members tend to rotate about operating shaft 104. These rotary members are generally arcuate and often circular. These members include:

hook plate 106 (FIGS. 5, 22A) concentrically positioned about shaft 104;

operator disk 108 (FIG. 5) also concentrically positioned about shaft 104;

expander 110 (FIGS. 11, 12) pivotally mounted to reset actuator 112 (FIGS. 11, 15) which is concentrically mounted to shaft 104, and on/off disk 114 (FIG. 11) being off cam concentrically mounted to shaft 104.

Figure 5:
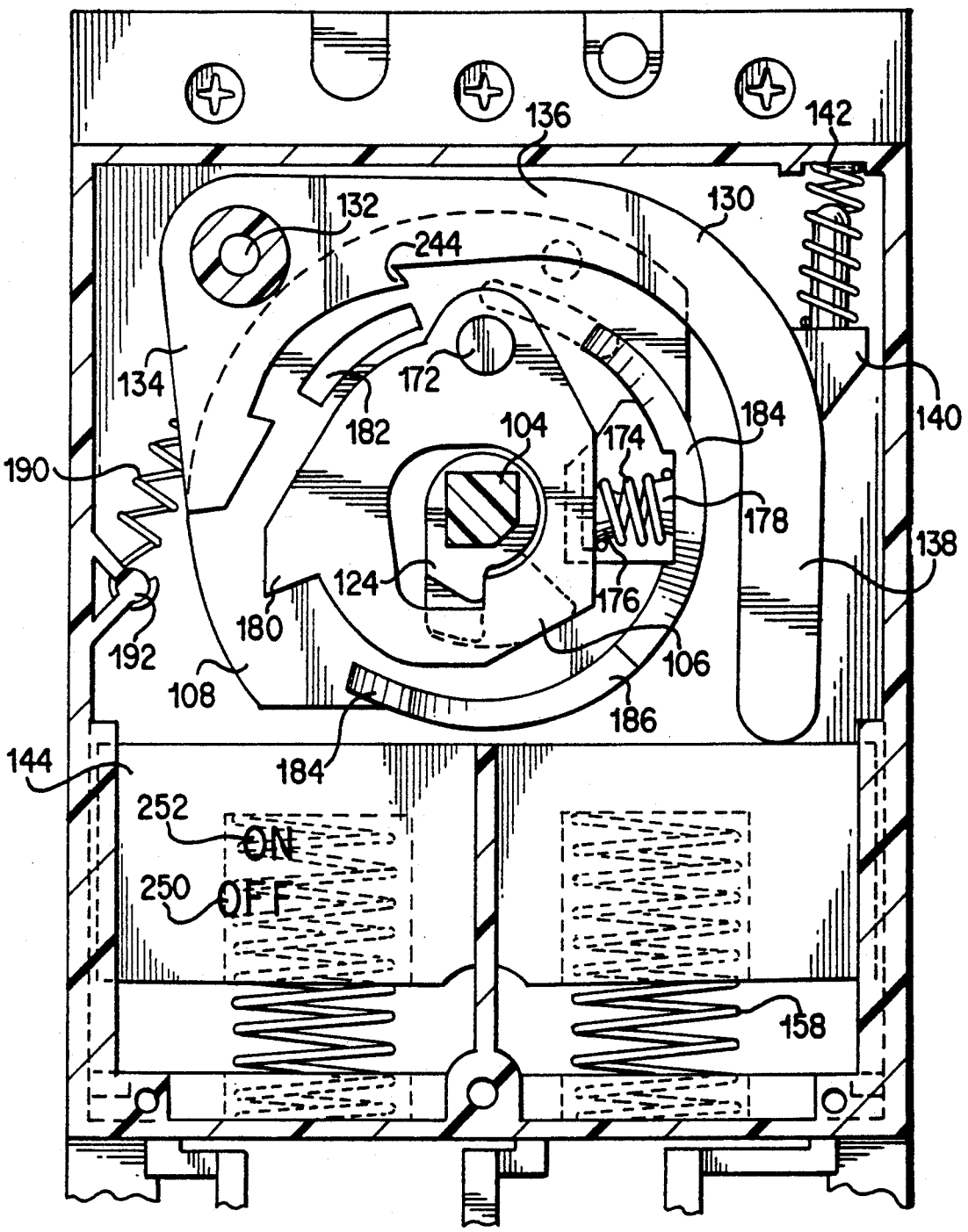
FIG. 5 is a sectional view along the lines 5—5 of FIG. 4.
Figure 6:
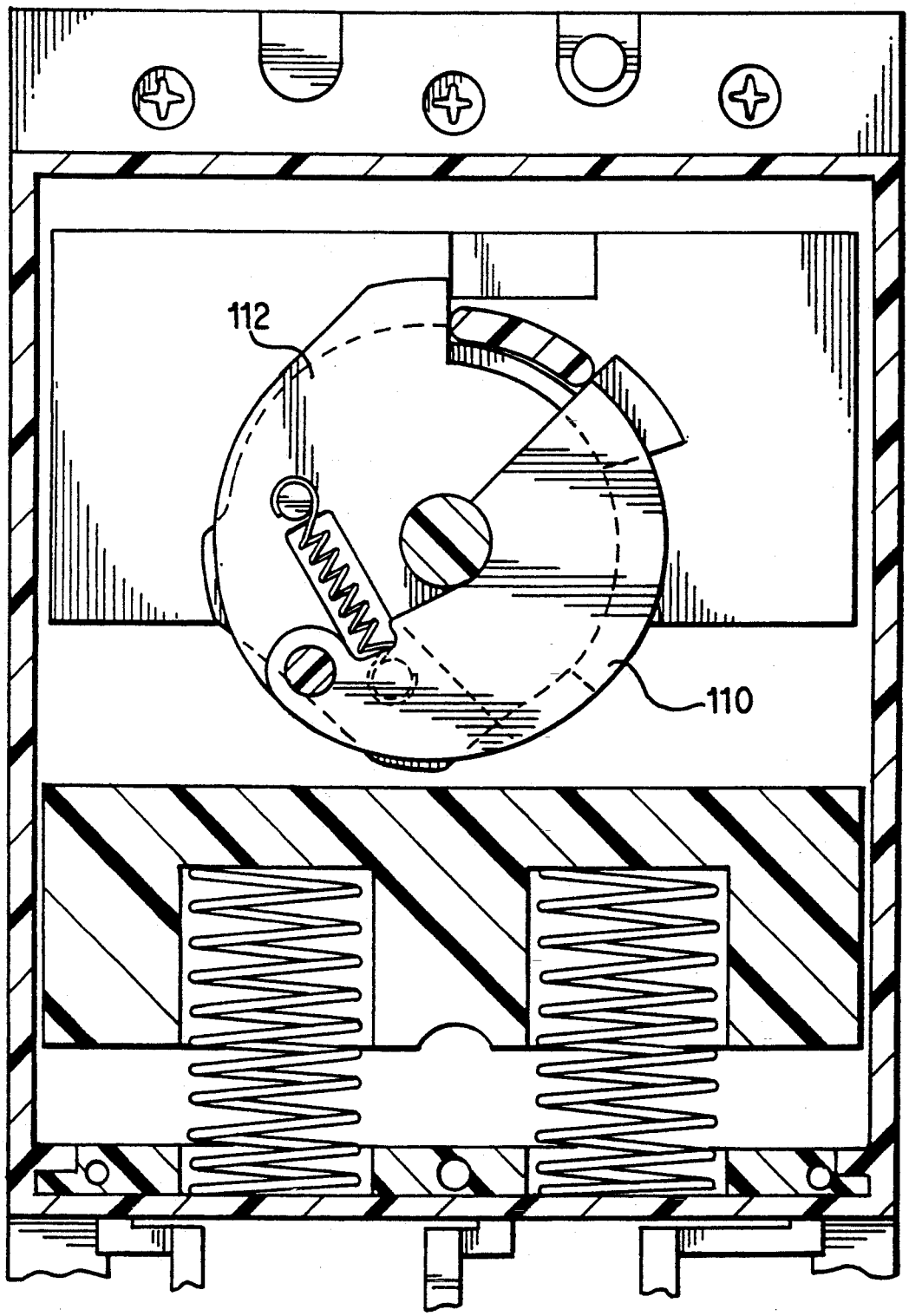
FIG. 6 is a sectional view along the lines 6—6 of FIG. 4.
Figure 7:
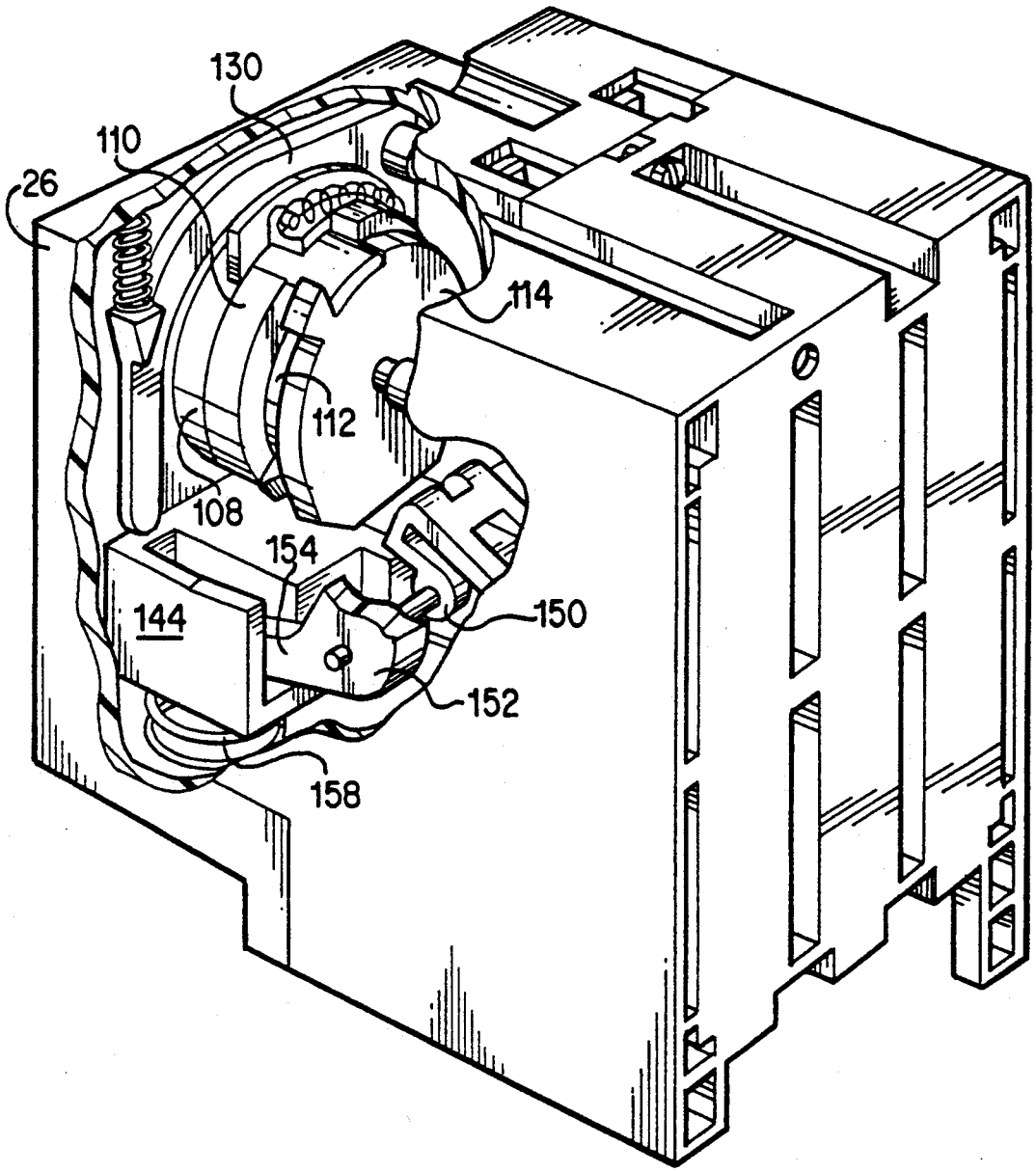
FIG. 7 is a perspective view of the compact circuit breaker of the present invention with portions of the enclosure broken away with elements missing for clarity.
Figure 8:
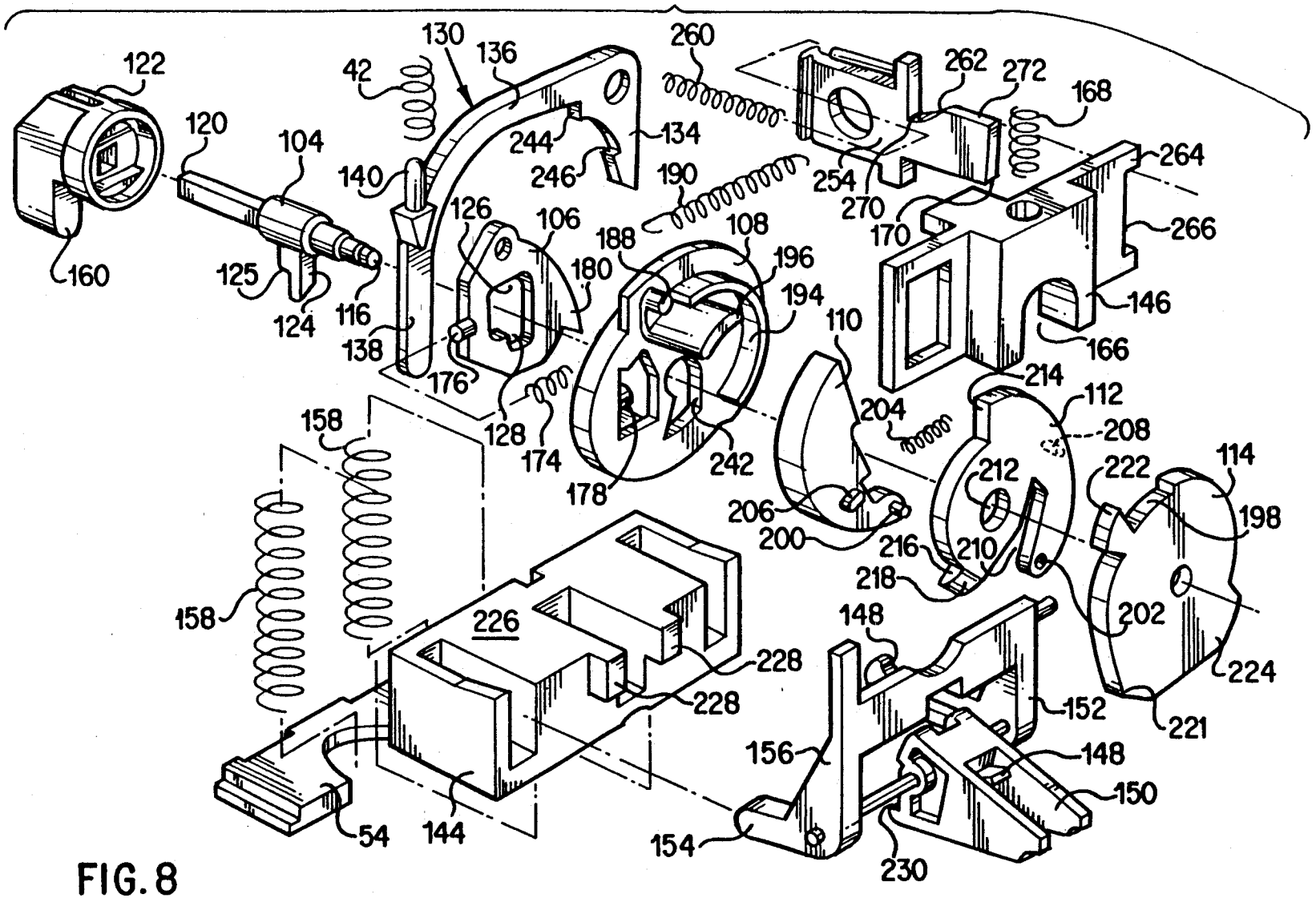
FIG. 8 is a partially exploded view of the compact circuit breaker of the present invention.
Figure 10:
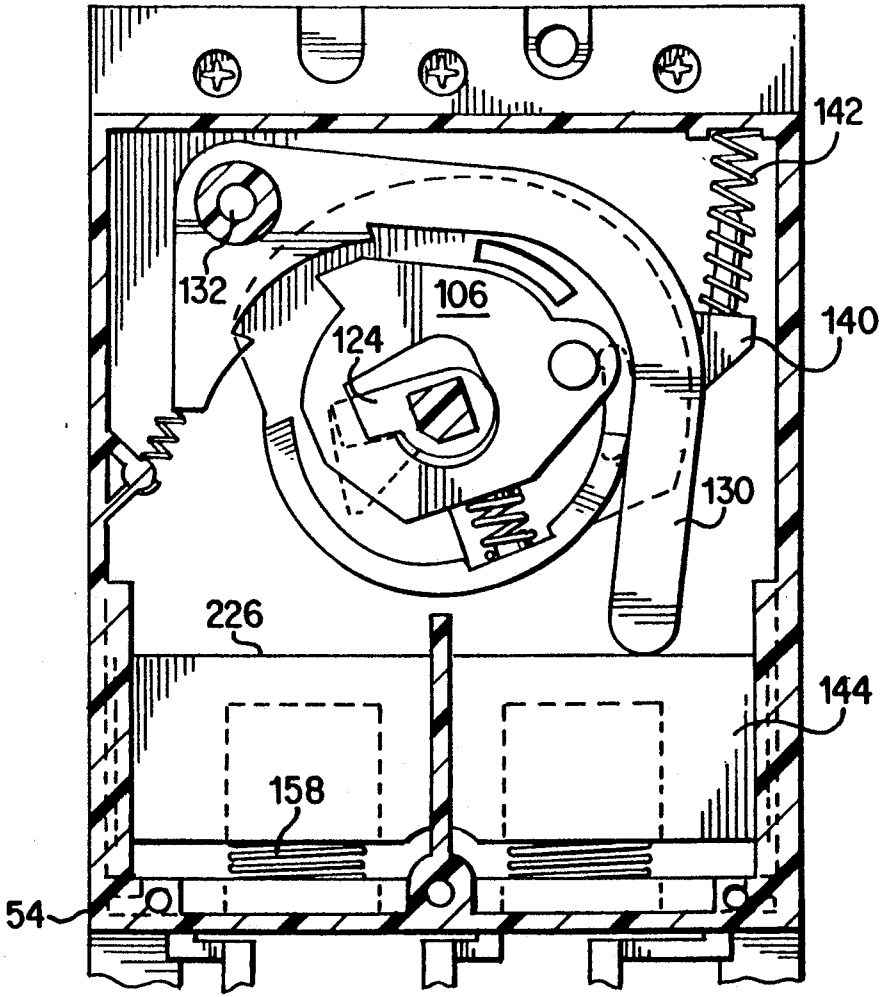
FIG. 10 is a cross section of the compact circuit breaker of FIG. 9 in a manner similar to FIG. 5.

Shaft 104 in this region has a plurality of reduced diameters for the rotary members ending in a bearing diameter 116 (FIG. 8) being the smallest diameter and received in bearing hole 118 (FIG. 23) of middle housing components #2 reference numeral 32. Opposite the end of shaft 104 having the bearing diameter 116 is knob end 120 (FIG. 8) terminating a keyed squarish portion of shaft 104 which extends beyond the face of top housing 26 to receive knob 122 (FIG. 3) which is generally elongate. Approximately midway between shaft end bearing diameter 116 and knob end 120 there is a operating lug 124 (FIG. 5) being a rectangular stepped body extending radially from the shaft. A portion of operating lug 124, step lug 125 (FIG. 8), selectively engages a central aperture 126 (FIG. 8) including an operating lug surface 128 (FIG. 8) engaged by step lug 125. These shaft rotary members rotate about a pivot axis parallel to operating shaft 104. Escapement 130 (FIGS. 5, 8) also rotates about a pivot axis 132 (FIG. 5) which is parallel to operating shaft 104. However, escapement 130 while interacting with rotary shaft member is generally U-shaped with one truncated leg 134 (FIG. 8), base 136 (FIG. 8) and plunger leg 138 (FIG. 8). On plunger leg 138 is a spring receptacle 140 (FIG. 5) for mounting escapement lever return spring 142 (FIG. 5) which biases escapement lever 130 towards trip plunger 144 (FIG. 5).

Trip plunger 144 and reset lever 146 (FIG. 8) can be generally categorized as miscellaneous components which often move rectalinearly such as contact carrier 80.

Contact lever train members include trigger 82 at one end interacting with brim 64 to initiate a trip operation, a trip lever 148 (FIG. 8), trip latch 150 (FIG. 8) and bell crank 152 (FIG. 8). Bell crank 152 has a plunger arm 154 (FIG. 8) and a carrier arm 156 (FIG. 8). When contacts are to be opened carrier arm 156, powered by trip springs 158 (FIG. 8) acting through plunger 144 and plunger arm 154, is rotated into engagement with the bell crank end 88 of the contact carrier 80 for each phase. Once initiated a trip or off operation continues until the contacts open fully.

Circuit Breaker 10 operates in four (4) modes. One mode is turning on from an off position where knob handle 160 (FIG. 8) is essentially in a horizontal position 90 degrees from a vertical on position. Turning on requires that knob 122 be moved manually into the on position generally illustrated in FIG. 14, from the off position generally illustrated in FIG. 3. A second operation is an off operation from a circuit breaker on position shown in FIG. 14 requiring an operator to rotate knob 122 to the horizontal position and in the process opening the contacts. Another operation is a trip operation from the condition where the breaker is on and solenoid 44 is activated causing a trip condition opening the contacts independently of manipulation of knob 122. The fourth operation is a reset operation where the knob 122 is at a 45 degree angle between the on and the off condition indicating the breaker has tripped. Reset occurs in moving knob 122 from the 45 degree position to the 90 degree position as in the later stages of an off operation. Manipulation of a knob 122 in an off operation in later stages initiates the same mechanism which causes a trip operation. Similarly, a reset operation occurs as part of an on operation once the knob is in the off position.

An on operation is illustrated in FIGS. 3–7, 9–17 and FIG. 20. In most sectional figures some components actually present as shown in exploded views or other figures are not illustrated for purposes of clarity in showing how components work together. FIGS. 3, 4, 5, 6 and 7 show the breaker 10 in a an off position. FIG. 4 shows ,reset lever 146 in its blocking position where crank surface 162 (FIG. 4) on the lower portion of reset lever 146 is blocking, block surface 164 (FIG. 4) near the end of plunger arm 154. Plunger arm 154 is bearing against bell crank end 88 of contact carrier 80. This blocks contacts 40, 42 in the open position as shown to the left of the drawing. Shaft recess 166 (FIG. 8) surrounds bearing boss 167 shown in FIG. 23 surrounding bearing hole 118 if hold-off spring 168 (FIG. 8) is maintaining reset lever 146 in the blocking or hold-off position and insuring that cam lip 170 (FIG. 8) is bearing against on/off cam 114. As long as reset lever 146 remains in a blocking position no accidental closure of the contacts can occur. If knob 122 is rotated towards the on position clockwise operating shaft 104 rotates clockwise carrying operator disk 108, hook plate 106 and on/off cam 114 in a clockwise rotation. Hook plate 106 is pivotally mounted to operator disk 108 by being pivoted on disk pivot 172 (FIG. 5) to the top housing 26 side of disk 108. Hook return spring 174 (FIGS. 5, 8) is mounted between hook post 176 (FIG. 8) on hook plate 106 and disk post 178 (FIG. 8) on operator disk 108. Spring 174 is biased to set plate hook 180 (FIG. 8) outward from shaft 104. Arcuate projection 182 (FIG. 5) limits the degree to which plate hook 180 extends outward from shaft 104. Arcuate semi-circle 184 (FIG. 5) extends toward top housing 26 end, as shown in FIG. 5, of arcuate semi-circle 184 stop lug 186 (FIG. 5) protruding further towards top housing 26 limits the rotation of shaft 104 by riding in a conformal arcuate groove on the interior of top housing 26. Similar structure of arcuate protrusions, lugs and pivot pins extend to the rear of disk 108. A knob post 188 (FIG. 8) anchors one end of knob return spring 190 (FIG. 5). The opposite end of knob return spring 190 is anchored to a spring anchor 192 (FIG. 5). Knob return spring 190 tends to rotate shaft 104 in a counter clockwise direction towards an open position of the breaker contacts 40,42. Arcuate spacer 194 (FIG. 8) rests against reset actuator 112 to allow free pivoting of expander 110 towards the top end of spacer 194, cam lug 196 (FIG. 8) projects rearwardly to on/off cam 114 and rests in lug notch 198 (FIG. 8) causing on/off cam to rotate with operating disk 108. Expander 110 includes an expander pivot post 200 (FIG. 8) received in actuator pivot hole 200 (FIG. 8). Expander return spring 204 (FIG. 8) is hooked at one end to expander post 206 (FIG. 8) and at the other to actuator post 208 (FIG. 8) and biases expander 110 to a minimum radius about shaft 104.

Adjacent spring post 208 is expander return spring slot 210 (FIG. 8) in actuator 112. Slot 210 as its name implies accommodates expander return spring 204.

Reset actuator 112 in conjunction with reset lever 146 and expander 110 resets circuit breaker 10 by allowing the contacts to be closed and in the process storing energy in the stored energy mechanism of trip plunger 144 and trip springs 158, for opening. Actuator 112 includes a central aperture 212 (FIG. 8) bearing a conformal diameter to shaft 104. A actuator stop 214 (FIG. 8) (on actuator 112) interacts with reset lip 170 (on reset lever 146) to prevent rotation of reset actuator 112 when reset lever 146 is closest to shaft 104. Reset lever 146 is biased towards this anti-rotation block by hold off spring 168 preventing rotation of reset actuator 112 and blocking rotation of bell crank 152 from the blocking position. Opposite actuator pivot hole 202 to the opposite side of slot 210 is expander support surface 216 (FIG. 8). The inclined surface 218 (FIG. 8) shown in FIG. 8 provides generous relief for the rotation of lever 148.

Trip surface 221 (FIG. 8) on the periphery of cam 114 engages trip lever 148 as breaker operating shaft 104 is rotated in a counterclockwise direction to turn the breaker off. Lever perimeter 224 (FIG. 8) engages reset lip 170 lifting reset lever 146 against the bias of spring 168 and lifting reset lever 146 to a nonblocking position during the latter stage of an on operation.

Figure 15:
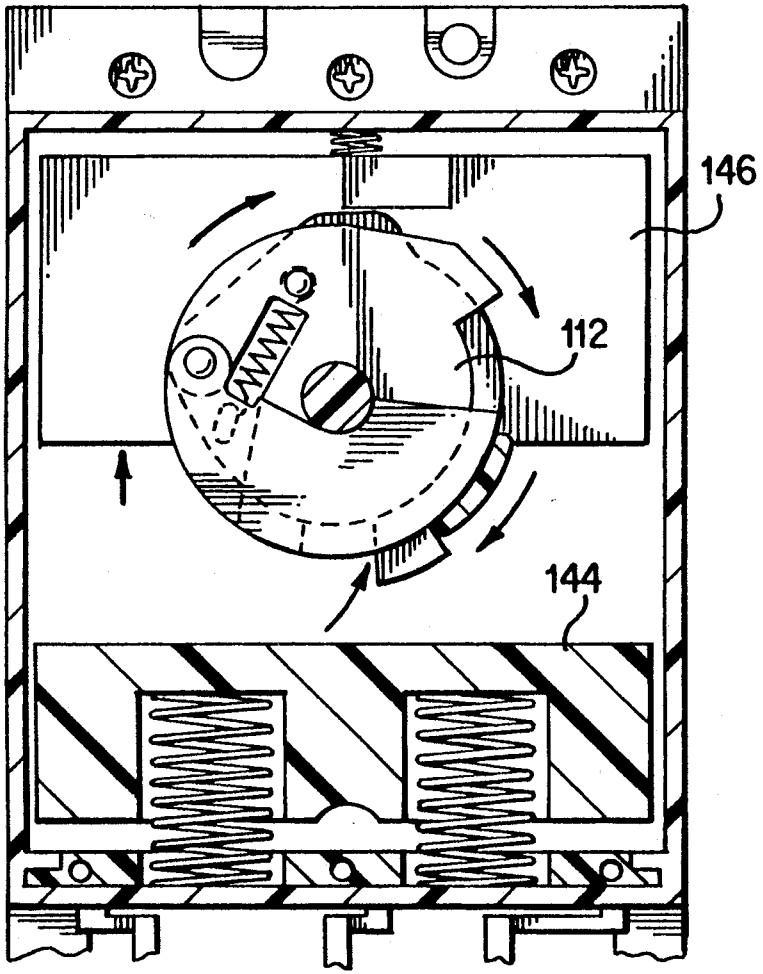
FIG. 15 is a cross section view of the compact circuit breaker of FIG. 14 in the manner of FIG. 6.
Figure 18A:
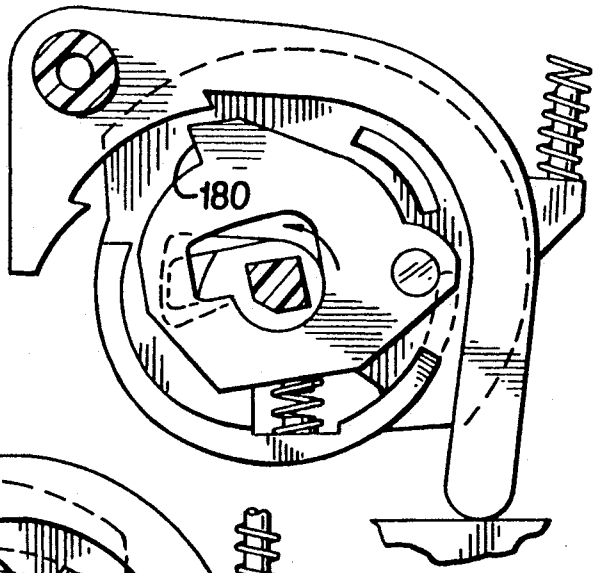
FIG. 18A is a cross section view illustrating the internal operating components of FIG. 17 at the beginning of a knob initiated off movement.
Figure 18B:
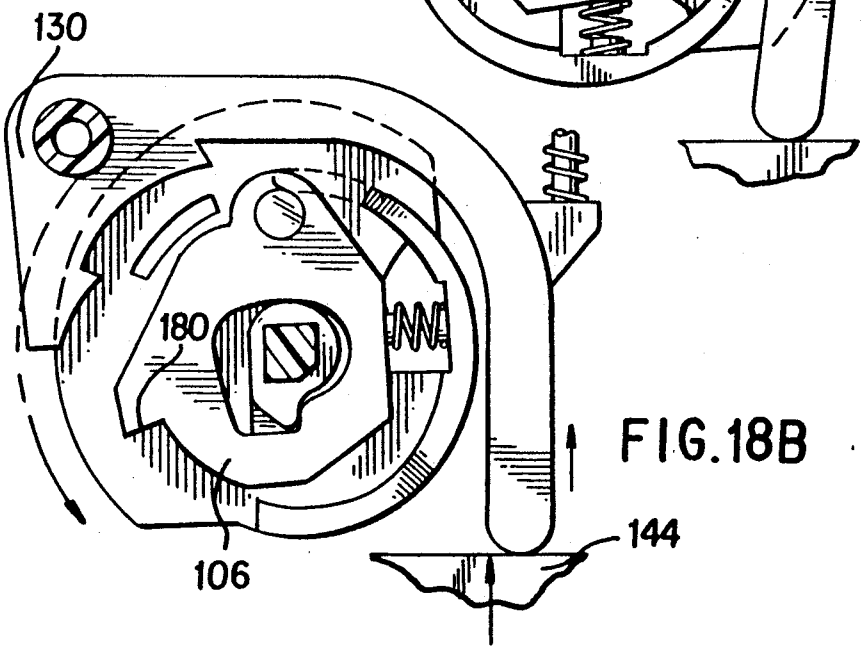
FIG. 18B is a continuation in movement of FIG. 18A showing the internal components of FIG. 18A as the turning off process continues.
Figure 17:
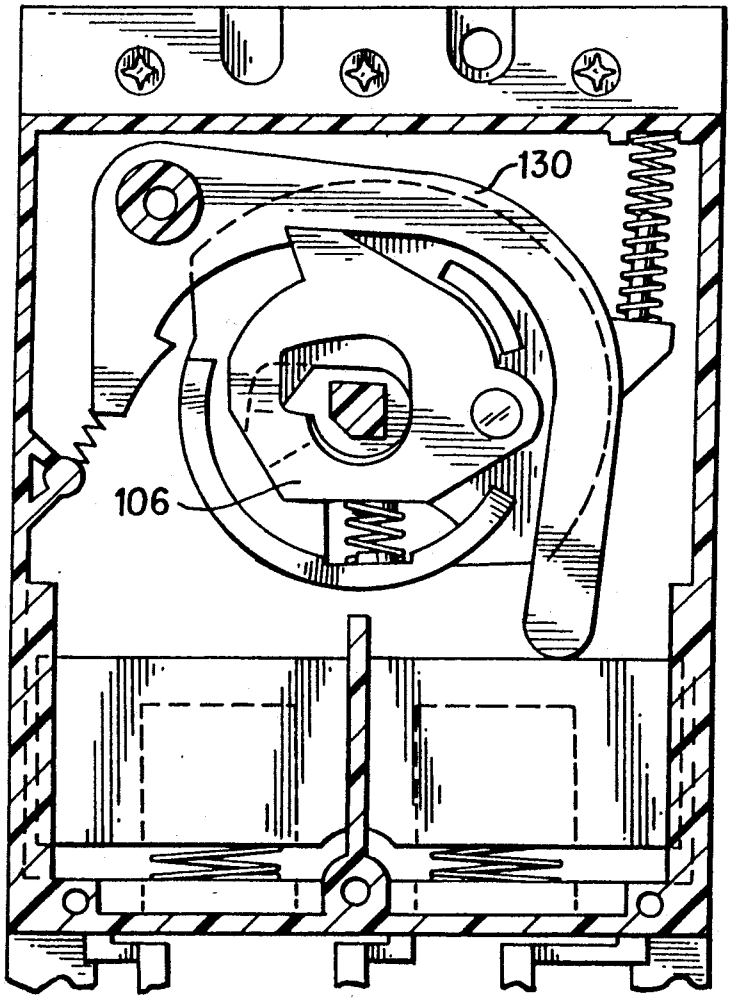
FIG. 17 is a simplified cross section view of the present invention shown in FIG. 14 in the manner of FIG. 5.
Figure 19:
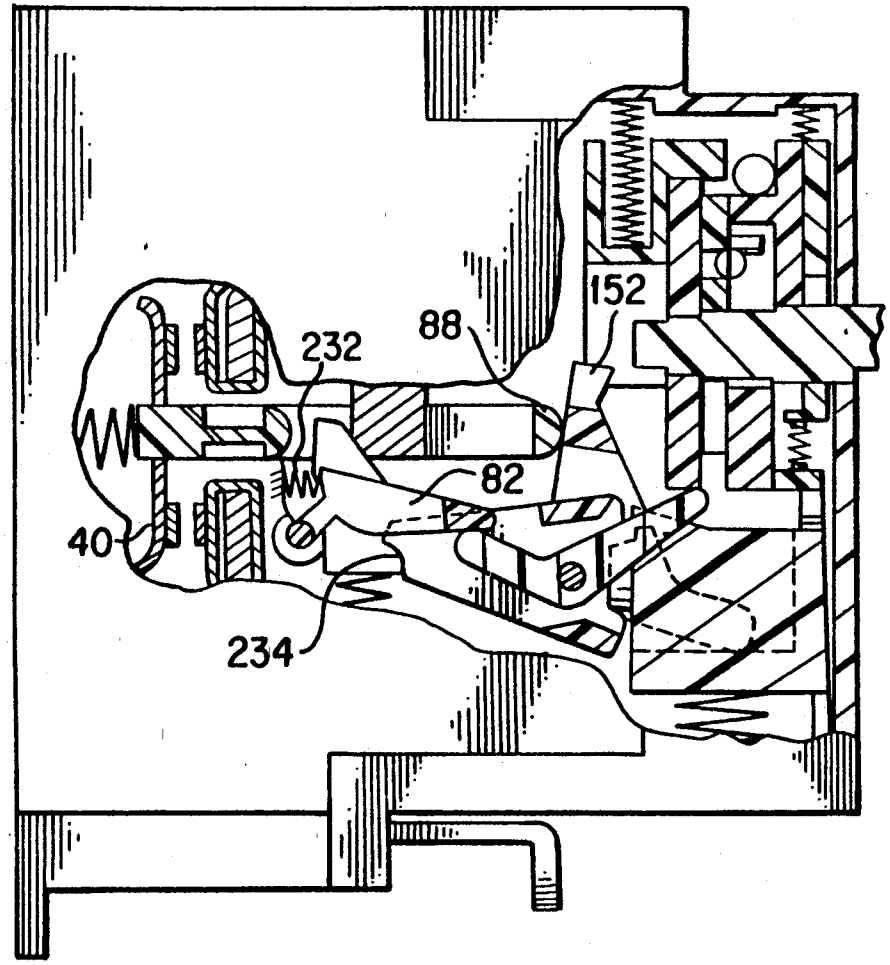
FIG. 19 is a cross section view similar to FIG. 4 showing the contacts in transition to the open position.
Figure 21:
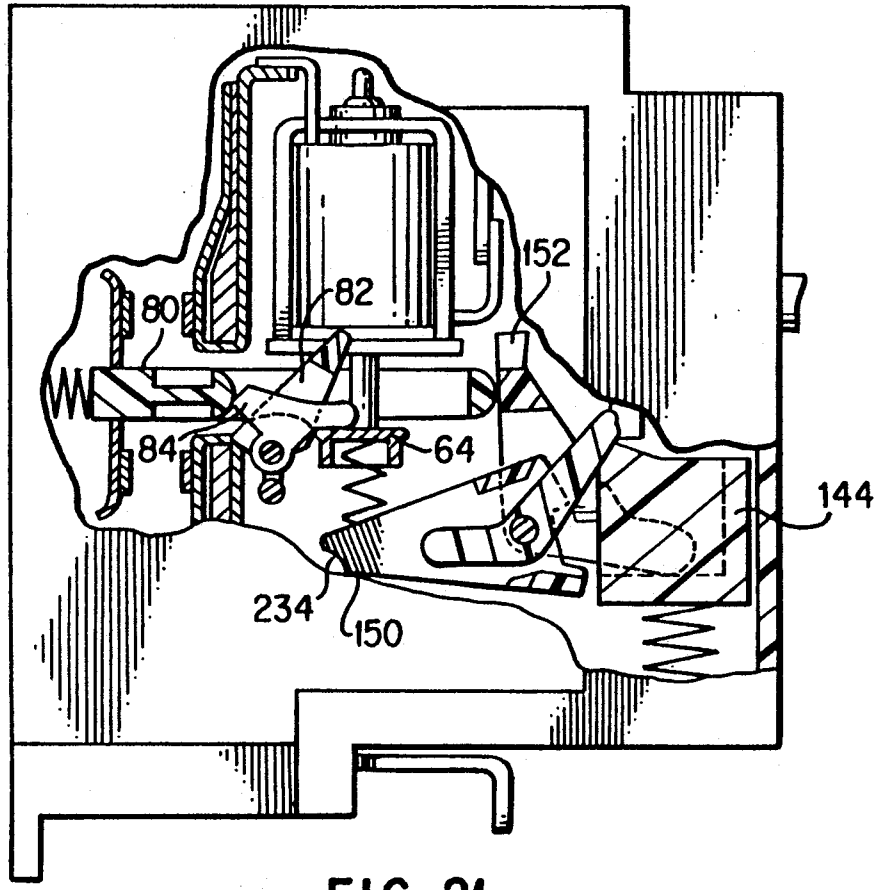
FIG. 21 is a cross section view showing the internal mechanism of the compact circuit breaker during a trip operation moving the contacts to an open position.
Figure 39:
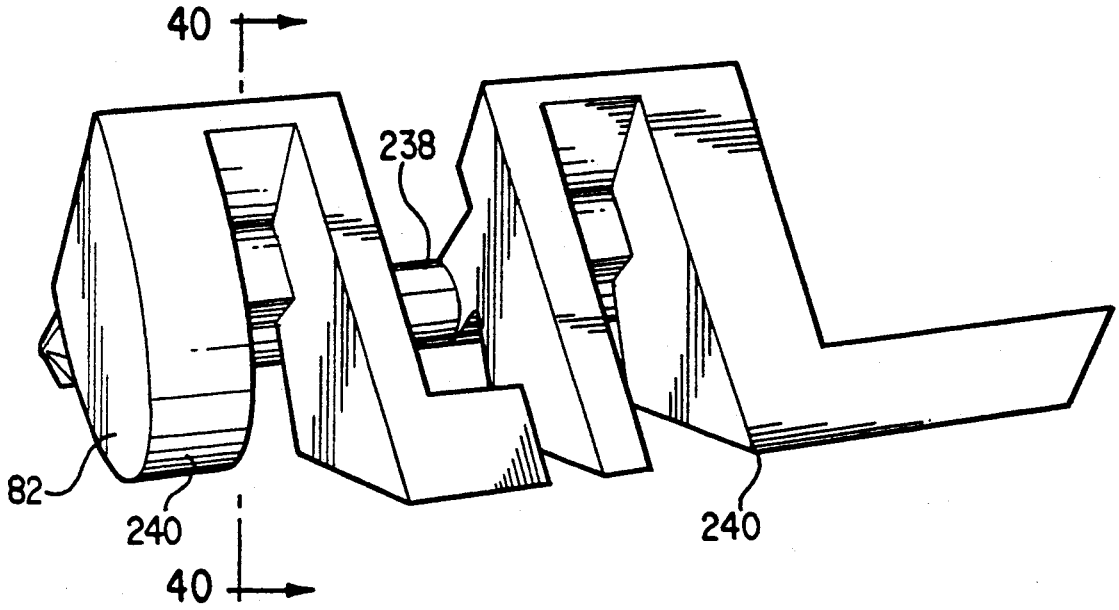
FIG. 39 is a perspective view of the trigger.
Figure 40:
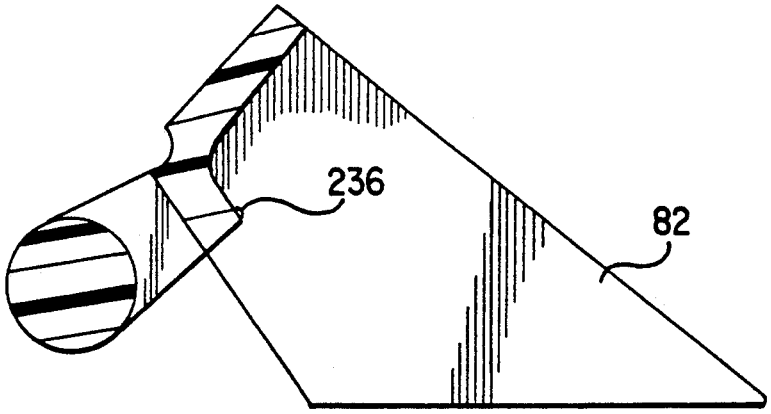
FIG. 40 is a cross section view taken along Line 40—40 of FIG. 39.

At the earlier stages of an on operation clockwise rotation of operator disc 108 forces expander 110 outward against expander surface 226 (FIGS. 8, 10) and compressing trip springs 158. As trip plunger 144 moves to compress trip springs 158, latch lugs 228 (FIG. 8) on plunger 144 engage plunger shelf 230 (FIGS. 8, 13) (on latch 150) causing trip latch 150 to rotate (clockwise). In turn, this causes contrary rotation in trigger 82 and compresses trigger return spring 232 (FIG. 19). As plunger 144 increasingly compresses trip springs 158, trip latch 150 rotates into a position where trip recesses 234 (FIG. 21) on trip latch 150 can engage latching lips 236 (FIG. 40) on trigger 82 (FIG. 40). Latching lips 236 are on the trigger pivot support 238 (FIG. 39) between outer brim arms 240 (FIG. 39). Brim arms 240 are impacted by brims 64, if the associated solenoid 44 is actuated. Engagement of latching lips 236 and trip recesses 234 occurs locking the contacts in the on position as in FIG. 20. At this point plunger 144 is also locked in position by latch lugs 228 and plunger shelf 230. Reset of the stored energy mechanism for opening the contacts is now complete as shown in FIG. 16. Bell crank 152 prevents the contacts from closing being yet blocked by reset lever 146. As knob handle 160 continues to be rotated clockwise/ operating lug 124 continues to bear against disc bearing 242 (FIG. 8) causing clockwise rotation of operator disc 108 and associated components. On off cam rotates lever perimeter 224 to lift reset lever 146 against hold off spring 168 bias as shown in FIG. 15. As soon as reset lip 170 clears actuator stop 214, expander 110 and reset actuator 112 pivot towards a relaxed state about shaft 104 (FIG. 15). Shortly thereafter continued rotation of shaft 104 withdraws lever 146 from blocking bell crank 152 and allows contacts 40, 42 to close. During the on operation plunger 144 increasingly compresses trip springs 158 and plunger leg 138 of escapement 130 follows plunger surface 226. As a result, on hook 244 (FIG. 5) approaches the periphery of hook plate 106. As contacts 40, 42 are closed, hook 180 (on hook plate 106) engages on hook 244 extending from escapement base 136. Breaker 10 is now in stable on state and will remain in that state until another operation is begun to move it to the off or trip positions where contacts 40, 42 are open. Until hooks 244, 180 are engaged release of knob 122 results in breaker 10 returning to the off position. Disengagement of hooks 244, 180 results in contacts 40, 42 opening. During a solenoid 44 initiated trip as plunger 144 may move plunger leg 138 to disengage the hooks 244, 180 at any time trip springs 158 are compressed. The knob handle 160 position cannot inhibit a solenoid 44 initiated trip which is independent of handle 160 mechanism.

If a fault occurs on a given phase, the associated solenoid 44 for the faulted phase initiates a trip operation for all phases. Brim 64 is moved into engagement with trigger 82 which rotates counter clock wise to withdraw latching lips 236 from trip recesses 234 on trip latch 150 and unlock the stored energy mechanism. A five to one ratio in lever arms of trip latch 150 lowers the required force of the solenoids 44. Trip plunger moves toward operating shaft 104 releasing the stored energy in trip springs 158 and causing bell crank 152 to rotate into bell crank end 88 of contact carrier 80. Continued release of the stored energy opens those contacts remaining in a closed condition. Before the stored energy mechanism can complete opening the contacts solenoid bell crank 84 is rotated into solenoid bell crank indentation 90 on contact carrier 80 opening the contacts in the faulted phase. The low inertia of solenoid bell crank 84 directly actuating contact carrier 80 results in early interruption of the faulted phase and lower dissipation requirements. The higher inertia and clearance tolerances of the mechanism initiated by trigger 82 results in a slower opening although trigger 82 is first actuated. Continued release of stored energy causes trip plunger 144 to rotate escapement 130 disengaging on hook 244 from hook 180 and moving trip hook 246 (FIG. 8) closer to hook plate 106. Shaft 104 then rotates to relax knob return spring 190 (counter clock wise) until hook 180 is caught by trip hook 246 after 45 degrees of rotation. At this point knob 122 provides an indication that breaker 10 is open as a result of a trip operation.

Figure 9:
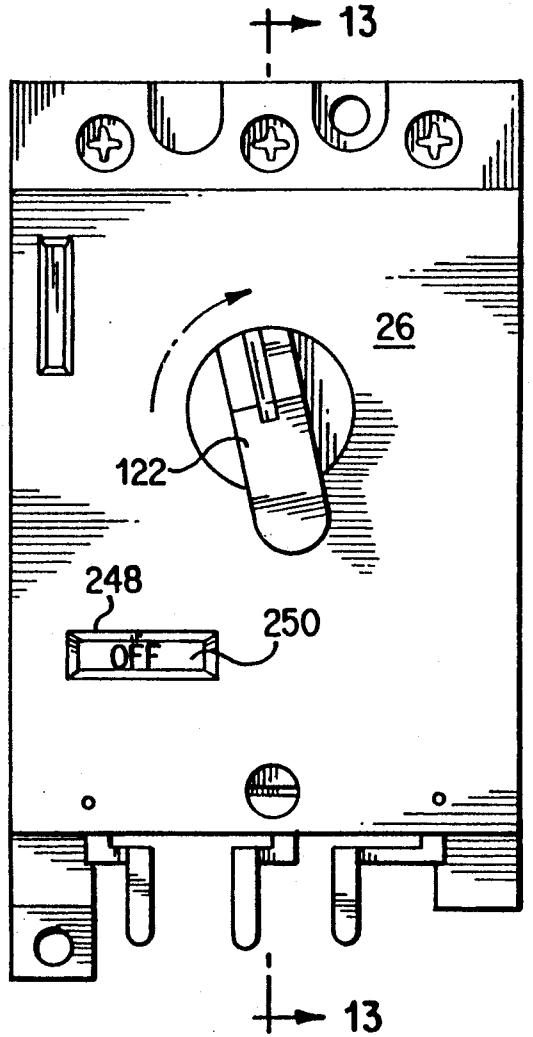
FIG. 9 is a depiction of the front panel of the compact circuit breaker of the present invention in the process of moving between a contact open position to a contact closed position.

A condition window 248 (FIGS. 2, 9) in top housing 26 beneath knob 122 provides a direct view of plunger 144, which when breaker contacts 38, 40 are in the open state displays the "off" indicia 250 (FIGS. 5, 9). When the breaker contacts 38, 40 are in the closed state an "on" indicia 252 (FIGS. 1, 2, 14) is visible due to the movement of plunger 144 to the stored energy position.

Release and counter clockwise rotation of shaft 124 to the trip position is sufficient to allow reset lever 146 to move into the blocking position of bell crank 152 and positioning lever 146 to allow a reset of the stored energy mechanism in a subsequent on operation. However, breaker 10 can not be turned on from a trip position. If an attempt is made to close breaker 10 from a trip position before turning knob 122 to an off position no stable condition results. Surface 214 of reset actuator 112 is not in a position acted upon by surface 170 of reset lever 146 and the turn on operation cannot be initiated. When knob 122 is released after such an attempt shaft 104 rotates counter clockwise (partially relaxing knob return spring 190) until hook 180 catches on trip hook 246.

Before the breaker can be turned to an on position, knob 122 must be rotated to the off position. The counter clockwise movement of shaft 104 brings stepped lug 125 into engagement with operating lug surface 128 on hook plate 106. The continued counter-clockwise rotation of shaft 104 results in hook 180 being withdrawn from engagement with trip hook 246 allowing further rotation of shaft 104 and associated members such as knob 122 to the full off position as best seen in FIG. 5. A similar counter clockwise rotation of knob 122 and shaft 104 when the breaker 10 is in the on position has a similar effect. Stepped lug 125 again rotates hook plate 106 by engaging operating lug surface 128 and withdrawing hook 180 from engagement with hook 244. Once hooks 244 and 180 are disengaged the knob return spring 190 causes counter clockwise rotation of the entire mechanism to a stop position. Disc bearing 242 is engaged by operating lug 124 to carry the remaining shaft rotary members in a counter clockwise direction until stop lug 186 reaches the end of the arcuate groove on the interior of top housing 26. Just before rotation ends surface 221 of on off cam 114 causes trip lever 148 to rotate clockwise (FIG. 20). In turn trigger 82 is rotated counter clockwise releasing the lock between trigger 82 and trip latch 150. As a result, the same action as a trip operation follows. The stored energies in trip springs 158 causes trip plunger 144 to move upwards rotating bell crank 152 into contact carriers 80. Contact carriers 80 are forced downward by carrier arm 156 opening movable contacts 40. FIGS. 19 through 22B illustrate various aspects of trip and off operations.

Figure 37:
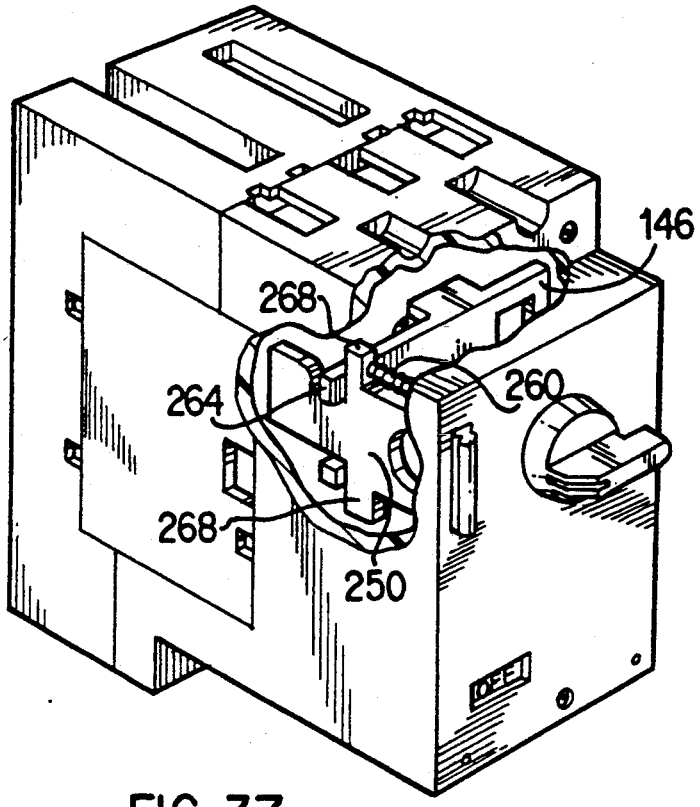
FIG. 37 is an abstracted view of the breaker of the present invention including its lockout-tab.
Figure 38:
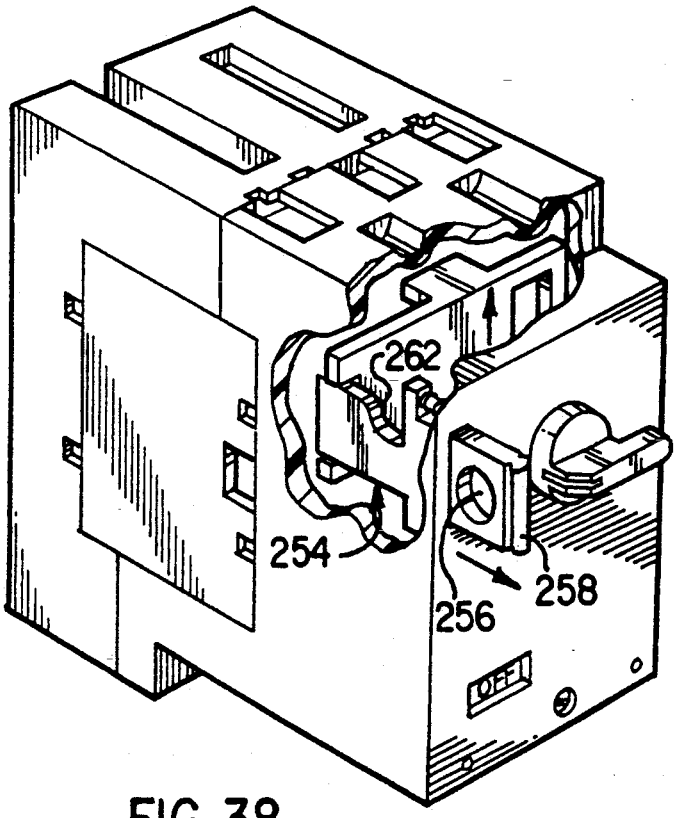
FIG. 38 is a similar view to that of FIG. 37 with a lockout tab in a blocking or lockout position.

FIGS. 37 and 38 of the application show lockout tab 254 (FIG. 8) and how it operates to prevent closing of breaker 10 when padlock hole 256 (FIG. 38) is exposed. If an operator wishes to prevent closure of breaker 10 when it is unattended the operator may seize grip 258 (FIG. 33) and extend tab 254 until hole 256 is exposed.

Movement of tab 254 against the bias of lockout bias spring 260 (FIG. 37) causes reset lever 146 to ride upward along reset medial ramp 262 (FIG. 38). Upper leg 264 (FIG. 37) of lockout indentation 266 (FIG. 8) rides along ramp 262 lifting cam lip 170 clear of engagement with reset actuator 112. Since the reset actuator 112 cannot be blocked from rotation breaker 10 cannot be turned to an on position. When lockout tab 254 has withdrawn inward, lateral arms 268 (FIG. 37) rest to either side of lockout indentation 266. Medial ramp 262 provides a transition between narrow height 270 (FIG. 8) and wider height 272 (FIG. 8) which lifts cam lip 170 and reset lever 146 upwards. FIGS. 30 through 34 illustrate the use of an auxiliary switch for two indicating functions. This switch although called auxiliary are often sold with breaker 10.

Figure 30:
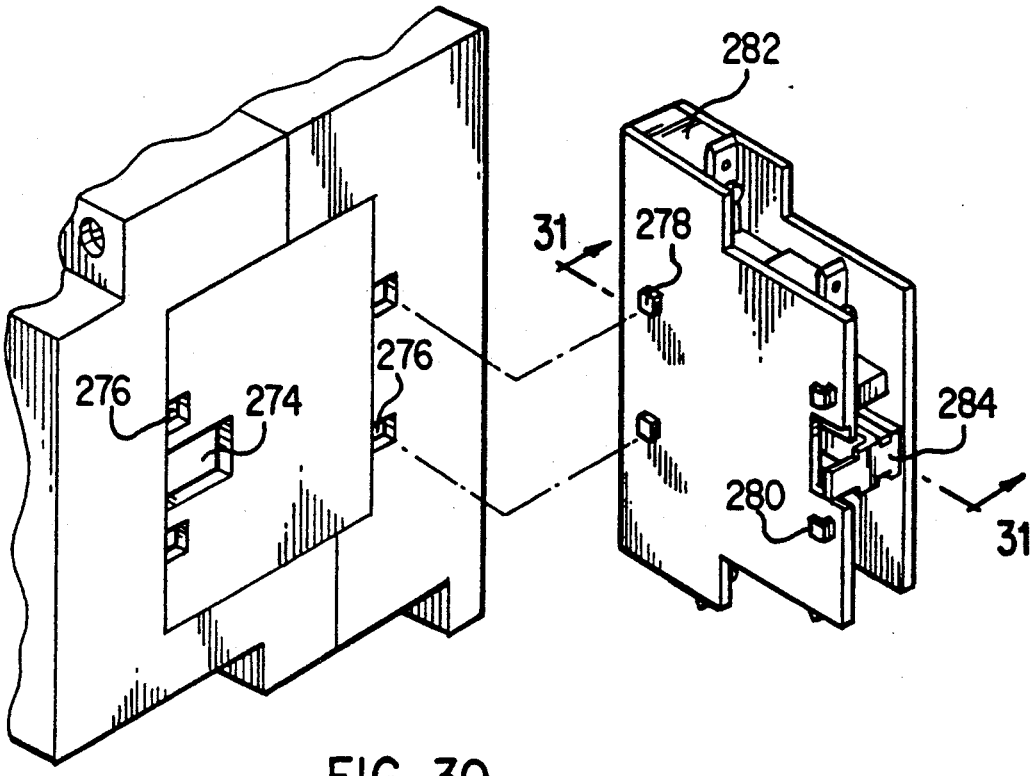
FIG. 30 is an exploded view showing a portion of the breaker of the present invention with an auxiliary switch.

FIG. 30 shows a perspective side view of breaker 10 middle housing component #1 reference numeral 30, including actuator tab hole 274, (FIG. 30) and mounting holes 276 (FIG. 30). Mounting holes 276 receive auxiliary locator, protuberances 278 (FIG. 30) and auxiliary hooks 280 (FIG. 30) to snap auxiliary switch 282 (FIGS. 30, 33) into place. This same scheme is used on the other side of breaker 10 also.

Figure 31:
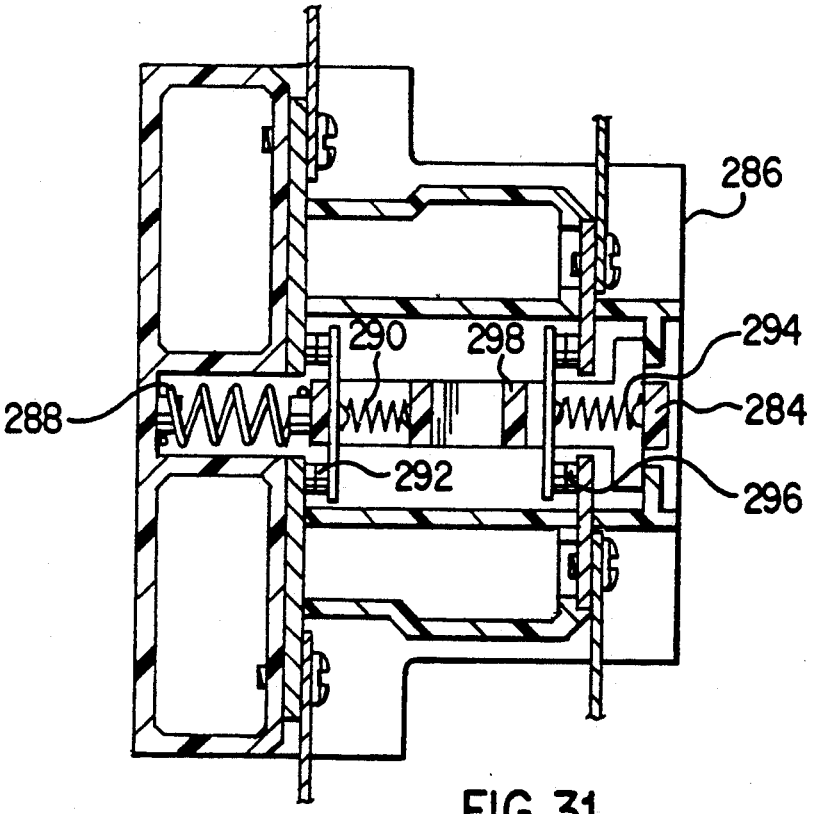
FIG. 31 is a cross section view of FIG. 30 along the lines of 31—31.
Figure 32A:
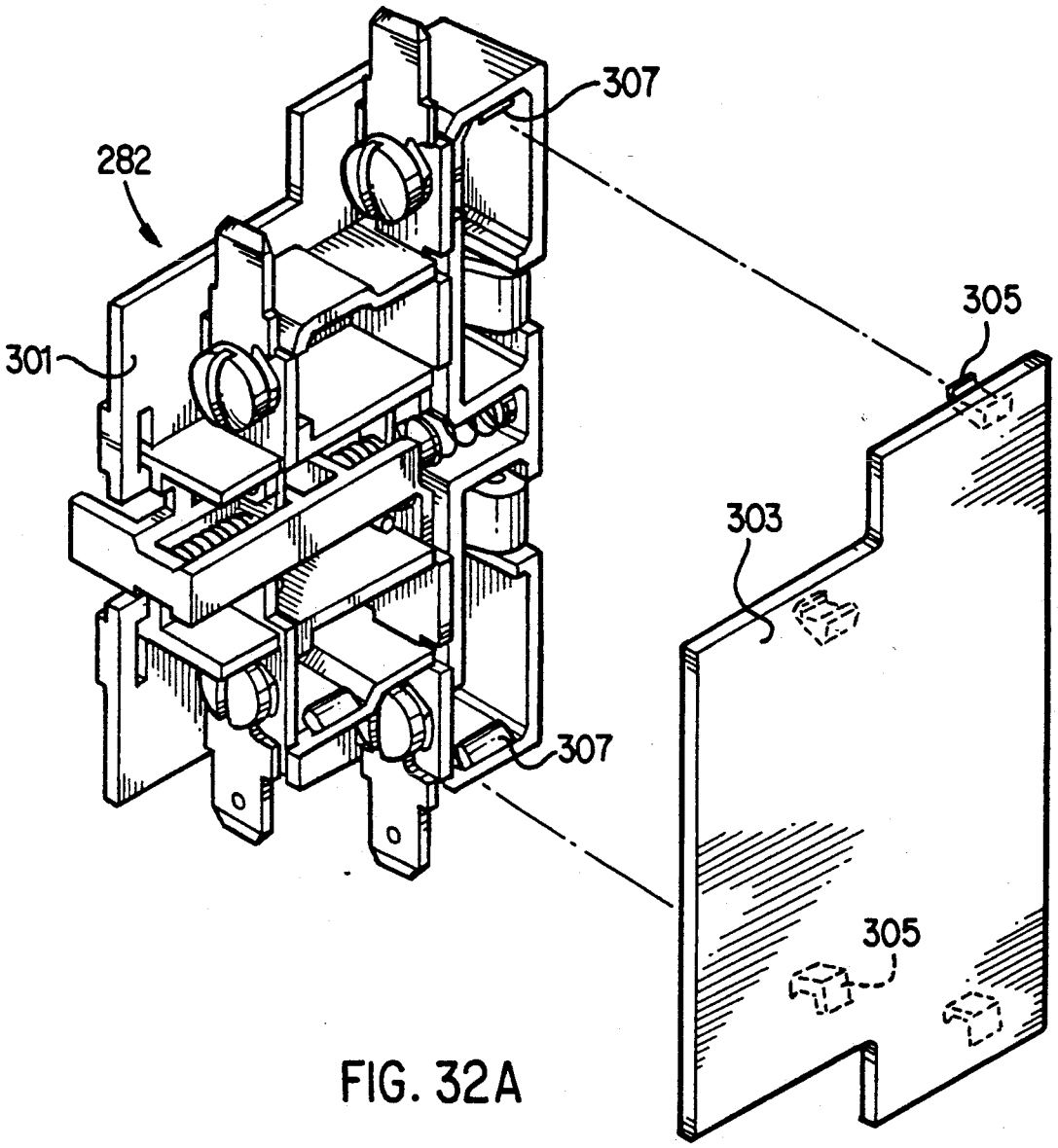
FIG. 32-A is a exploded view of the switch of FIG. 31.
Figure 32B:
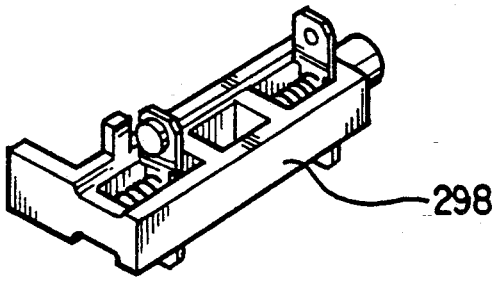
Figure 35:
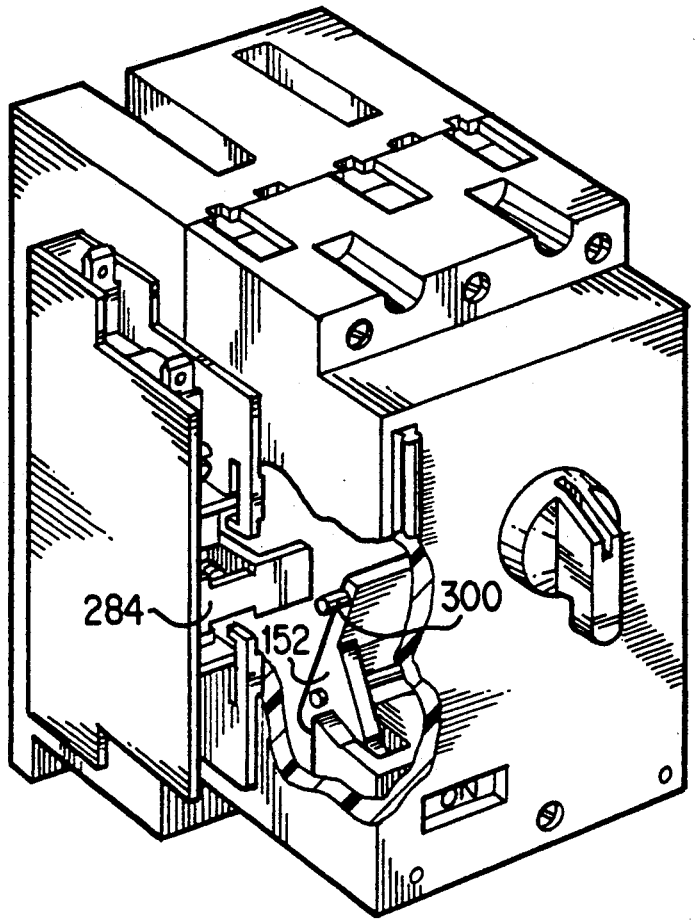
FIG. 35 is a depiction of the breaker of the present invention with the auxiliary switch interacting with a portion of the breaker to give an indication of the on off status of the breaker.
Figure 36:
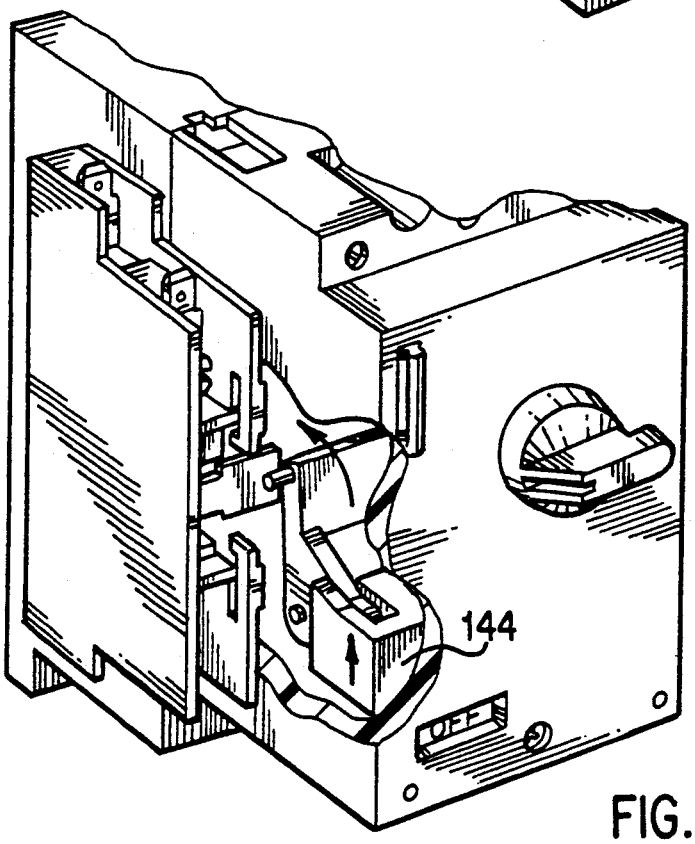
FIG. 36 is a view of the breaker and auxiliary switch when the breaker is in an off position.

FIG. 31 is a cross section of auxiliary switch 282 along the line 31—31 of FIG. 30. Switch 282 is shown in the actuated position with actuating tab 284 (FIGS. 30, 35) moved inward of switch front edge 286 (FIG. 31). Auxiliary contact spring 288 (FIG. 31) is compressed as is normally open contact spring 290 (FIG. 31). Normally open contacts 292 (FIG. 31) are closed. However, normally closed contacts spring 294 (FIG. 31) is extended because normally closed contacts 296 (FIG. 31) have welded. The spring loaded connection between normally closed contacts 296 and auxiliary contact carrier 298 (FIG. 32B) provides a yielding connection in the event that normally closed contacts 296 are welded as illustrated. If this is not done, auxiliary protuberance 300 (FIG. 35) on bell crank could lodge against actuating tab 284 (FIGS. 35 and 36) and prevent breaker 10 from tripping. FIGS. 35 and 36 are intended to illustrate the interaction between auxiliary switch actuating tab 284 and protuberance 300 in the movement from on to off position. In the event the contacts are welded, springs 290, 294 provide enough elasticity of the connection between carrier 298 and contacts 292, 296 to allow protuberance 300 to slip by. The partial enclosure of auxiliary switch 284 consists of auxiliary base 301 (FIG. 32) and auxiliary cover 303 (FIG. 32A). Auxiliary cover 303 is retained on auxiliary base 301 by cover hooks 305 (FIG. 32A), on auxiliary cover 303 latching on to base lips 307 (FIG. 32A). FIG. 32A is an exploded view of auxiliary switch 282. FIG. 32B is a perspective view of carrier 298 and associated components. The remaining components of switch 282 are relatively identifiable to one skilled in the art.

Figure 3:
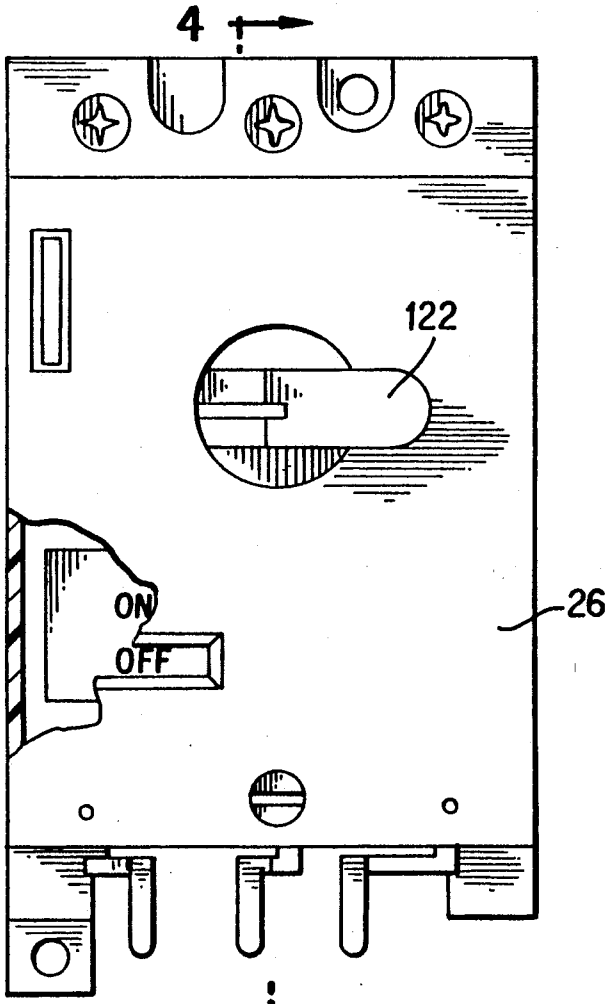
FIG. 3 is a plan view of the face of the compact circuit breaker.
Figure 33:
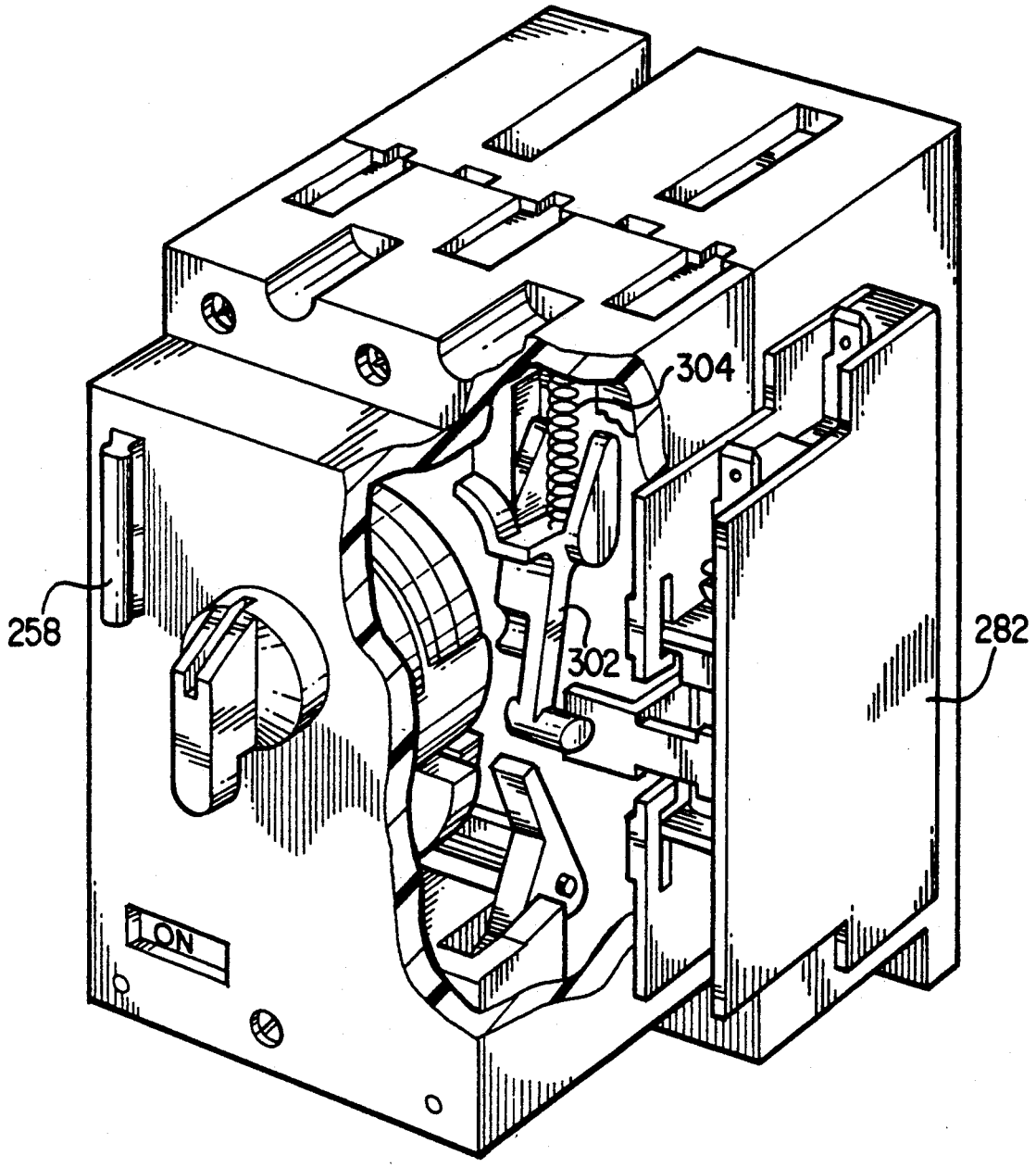
FIG. 33 is a perspective view of the breaker of the present invention in association with the auxiliary switch with the enclosure of the breaker broken away to show the inner-connection between the two.
Figure 34C:
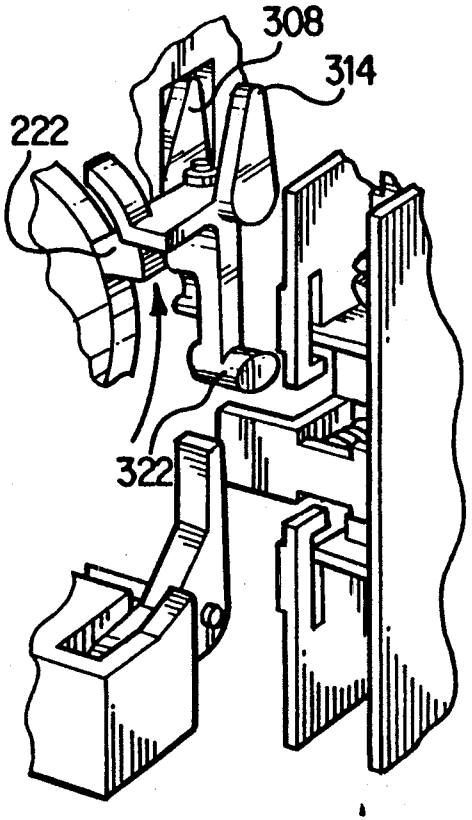
FIG. 34C is a view of the compact circuit breaker and components when the breaker is manually turned to the off condition.
Figure 34B:
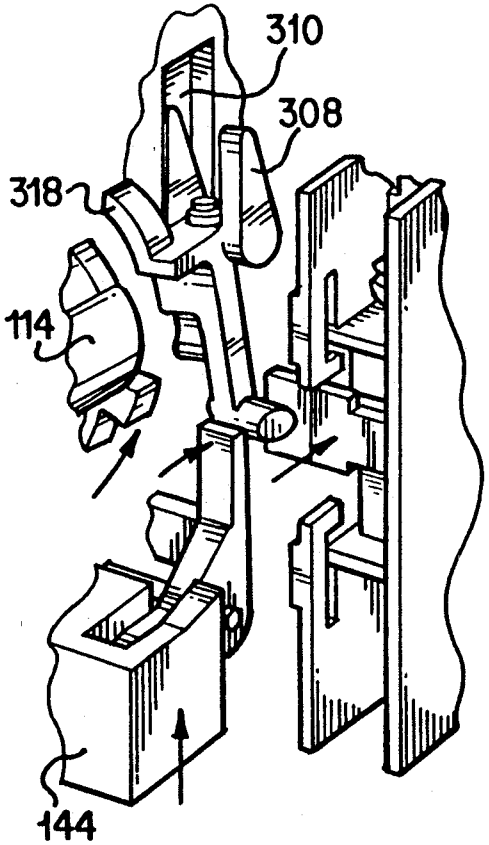
FIG. 34B has a view of the components when the compact circuit breaker is tripping.
Figure 34A:
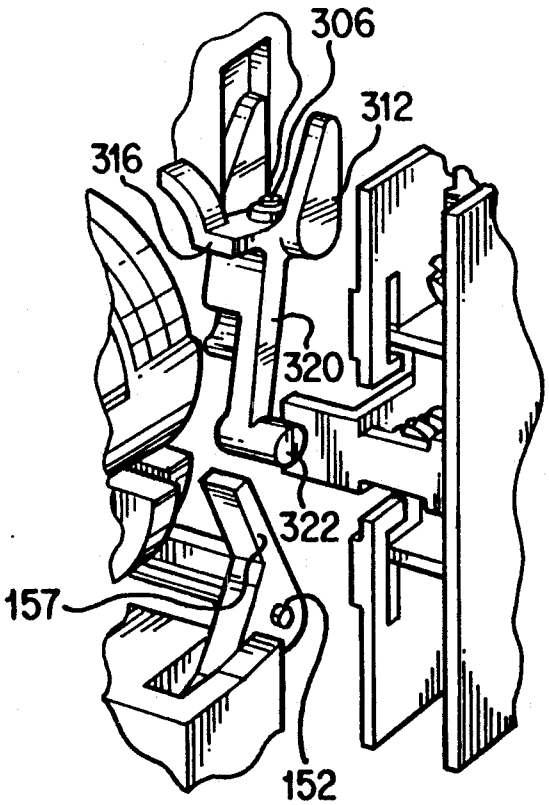
FIG. 34A is an abstracted view of compact circuit breaker components of FIG. 33 which activate the auxiliary switch, and the auxiliary switch.

FIGS. 3 and 34 show auxiliary switch 282 mounted to the right side of breaker 10 where it acts as an trip indicator which is only actuated when breaker 10 is in a trip condition. Although auxiliary switch 282 needs no modification to act as a trip indicator, internal components must be added to the interior of breaker 10. Trip switch lever actuator 302 (FIG. 33) is spring biased to a crank position by a trip switch lever return spring 304 (FIG. 33) as shown in FIG. 33. Lever spring 304 is mounted to lever 302 by lever post 306 (FIG. 34A) at one end and is abutted against the interior of top housing 26 at the other. Lever 302 is of a relatively complex design having four arms as best seen in FIGS. 34. Two tear drop arms 308 (FIG. 34C) ride in tear drop grooves 310 (FIG. 34B) of adjacent middle housings. The tear drop base portion 312 (FIG. 3A) of arm 308 provides guided reciprocal movement of lever 302. The narrow apex 314 (FIG. 34C) allows pivotal movement of arm 302 as appropriate. The post 306 and arms 308 all project upward from lever 302. A continuation of upper shelf 316 (FIG. 34A) is carried forward towards on off cam 114. Nearest to cam 114 shelf 316 continues as an arcuate arm 318 (FIG. 34B) extending upwardly and towards the center of breaker 10. Club arm 320 (FIG. 34A) descends in a downward direction from upper shelf 316 and terminates in club 322 (FIGS. 34A, 34C). FIG. 34A is an abstracted view of terminates portions of the mechanism of breaker 10 and switch 282 if breaker 10 is in the on position. If breaker 10 is tripped bell crank 152 auxiliary trip lever 157 is rotated into club 322. In turn club 322 rotates into actuator tab 284 as indicated in FIG. 34B. In contrast, if knob 122 initiates an off operation, trip tab 222 impacts against the bottom of upper shelf 316 lifting and pivoting lever 302 out of position to prevent club 322 from transmitting the movement of trip lever 157 to actuator tab 284.

As those skilled in the art will readily recognize, some of the invention elements may be interchanged, for example those shown as integral may be separated or those separated may be made integral without adversely affecting the performance of the invention.

From the foregoing description it will be apparent that modifications can be made to the compact circuit breaker of the present invention without departing from the teaching of the invention. Also it will be appreciated that the invention has a number of advantages, some of which have been described above and others of which are inherent in the invention. Accordingly, the scope of the invention is only to be limited as is necessitated by the accompanying claims.

We claim:

1. A low dissipation compact circuit breaker for selectively conducting breaker current in a circuit to be protected comprising:

an enclosure;

a stationary contact and a movable contact with selectively assume one of two possible states, a contiguous closed state conducting breaker current, and a noncontiguous open state preventing conduction of breaker current;

a rotary operator means selectively movable between an on position and an off position, for causing said stationary contact and said movable contact to assume one of said closed and open states;

a sensing trip means for sensing breaker current, said trip means causing said rotary operation means to move said contact from said closed state to said open state by directly acting to cause said contact to begin to assume said open state in a trip operation should said breaker current reach a preselected trip value;

said rotary operator means, when manually rotated from said on position to said off position, causes said contacts to move from a closed to an open position by initiating a trip operation.

2. The low dissipation compact circuit breaker of claim 1 wherein said breaker is to be used with a suitable current rating of a family of contactors, said family comprising a number of different current ratings, said breaker further including:

a line terminal including a planar tab having a side notch preventing withdrawal of said planar tab; and load terminals being stabs which are offset and spaced to fit only one current rating of said family of contactors.

3. The low dissipation compact circuit breaker of claim 1 wherein:

said rotary operator means, when rotated to cause said contacts to move from an open position to a closed position, causes a trip spring to be compressed thereby placing said sensing trip means and said rotary operation means in condition for opening in a trip operation.

4. The low dissipation compact circuit breaker of claim 1 wherein said sensing trip means includes a single trip solenoid for at least one phase to be protected, said single trip solenoid activated by both high and low faults exceeding said trip value of said breaker circuit.

5. The low dissipation compact circuit breaker of claim 1 wherein said circuit breaker is multiphase and all phases conducted are to be protected and an individual trip solenoid protects each phase.

6. The low dissipation compact circuit breaker of claim 4 wherein said trip solenoid saturates near said trip value.

7. The low dissipation compact circuit breaker of claim 4 wherein said trip solenoid includes a trip solenoid winding which is bi-filar.

8. The low dissipation compact circuit breaker of claim 5 wherein each said trip solenoid includes an individual adjustable trip level means or individually varying said trip level and a common circuit breaker adjustable trip level means for simultaneously varying said trip level of each trip solenoid.

9. The low dissipation compact circuit breaker of claim 8 wherein there is a maximum circuit breaker trip level adjustment, adjusted for each breaker, set by the manufacturer of said breaker which set maximum may not be readily exceeded by a user adjustment in the field.

10. The low dissipation compact circuit breaker of claim 8 wherein each said individual adjustable trip level means includes a solenoid return spring opposed by an adjustment spring to preload a solenoid plunger and adjust the trip level of each individual trip solenoid.

11. The lower dissipation compact circuit breaker of claim 9 including common adjustment means for adjusting said trip level for said breaker with a single adjustment setting the same trip level for each solenoid.

12. A low dissipation compact circuit breaker for selectively conducting breaker current in a circuit having at least one phase to be protected comprising:

an enclosure;

a stationary contact and movable contact with selectively assume one of two bistables, a contiguous closed state conducting breaker current, and a noncontiguous open state preventing conduction of breaker current;

a rotary operator means for selectively causing said stationary contact and said movable contact to assume one of said closed and open states;

a sensing trip for sensing breaker current in each phase conducted, for causing said rotary operation means to move said contacts from said closed state to said open state, and for directly acting to cause said contacts to begin to assume said open state in a trip operation, when said breaker current reaches a preselected trip value, including an individual phase trip solenoid sensing each phase current and initiating movement of said rotary operation means;

each said trip solenoid including an individual adjustable trip level for individually varying said trip level;

a compact circuit breaker adjustable trip level means for simultaneously varying said trip level of each trip solenoid, wherein there is a maximum circuit breaker trip adjustment, adjusted for each breaker, set by the manufacturer of said breaker which maximum may not be readily exceeded by a user adjustment in the field;

common adjustment means for adjusting said trip level for said breaker with a single adjustment setting the same trip level for each solenoid;

said common adjustment means is adjusted by inserting a tool into an adjustment access hole;

said breaker includes a tamper plug which blocks access to said adjustment means and can only be removed by destroying said tamper plug which signals the attempt to tamper;

said rotary operator means when causing said contacts to move from a closed to an open position does so by initiating a trip operation.

13. The low dissipation compact circuit breaker of claim 11 wherein:

said common adjustment means includes:

a pivot shaft to which a trip adjustment lever of each solenoid is pivotally mounted, said trip adjustment lever having a spring cup at one end and an angled adjustment face at the pivotally mounted end; and a trip adjustment beam containing an individual trip screw for each solenoid bearing against said angled adjustment face and a beam adjustment screw for adjusting the positron of the beam with respect to said angled adjustment face.

14. The low dissipation compact circuit breaker of claim 1 wherein:

each said movable contact is carried on a contact carrier; and each solenoid includes a bell crank directly acting on said contact carrier to impact each associated contact carrier and cause said movable contact to move toward said non-contiguous open state.

15. The low dissipation compact circuit breaker of claim 14 wherein:

said movable contact is slidingly fitted on said contact carrier and is initially blow toward the open state by magnetic forces resulting from high breaker current conditions in a faulted phase before said carrier substantially moves to said open position.

16. The low dissipation compact circuit breaker of claim 15 wherein:

said breaker further includes a contact spring biased to position said movable contact on said carrier.

17. The low dissipation compact circuit breaker of claim 16 wherein:

said contact spring fitting between a spring seat and said movable contact abutting a carrier shoulder and about carrier chisel end projecting beyond said movable contact.

18. The low dissipation compact circuit breaker for selectively conducting breaker current in a circuit to be protected comprising:

an enclosure;

a stationary contact and a movable contact which selectively assume one of two bistable states, a contiguous closed state conducting breaker current, and a noncontiguous open state prevent conduction of breaker current, wherein each said movable contact is carried on a contact carrier, said movable contact mass not being in substantial excess of said contact carrier mass, be being slidingly fitted on said contact carrier and is initially blown toward the open state by magnetic forces resulting from high breaker current conditions before said carrier substantially moves to said open position, said movable contact positioned on said carrier by a biased contact spring fitting between a spring seat fabricated from shock absorbing material, and said movabe contact abutting a carrier sholder and about a carrier chisel end projecting beyond said movable contact;

a rotary operator means for selectively causing said stationary contact and said movable contact to assume one of said closed and open states;

a sensing trip means for sensing breaker current, for causing said rotary operation means to move said contacts from said closed state to said open state, and for directly acting to cause said contacts to begin to assume said open state in a trip operation, if said breaker current reaches a preselected trip value;

said sensing trip means includes a single trip solenoid for each at least one phase to be protected;

each solenoid includes a solenoid bell crank directly acting on said contact carrier to impact each associated contact carrier and cause said moving contact to move from said contiguous state;

said rotary operator means when causing said contacts to move from a closed to an open position does so by initiating a trip operation.

19. The low dissipation compact circuit breaker of claim 1 wherein:

said rotary operator means includes a plurality of shaft rotary members on an operating shaft in a first direction; and contact lever train rotating in a second direction.

20. The low dissipation compact circuit breaker of claim 19 further including:

trip energy storage means for storing and supplying energy to open said contacts of said breaker; and wherein said contact lever train is connected among a contact carrier and said shaft rotary members and said energy storage means;

said contact lever train includes a trip latch having a short lever arm operatively connected to said shaft rotary members and said trip energy storage means, and a longer lever arm operatively connected to a solenoid actuated by said trip current.

21. The low dissipation compact circuit breaker of claim 20 wherein said trip energy storage means includes a trip spring;

a trip plunger which reciprocates between an open position corresponding to said open position of said contacts and a plunger closed position corresponding to said closed position of said contacts; and said trip spring biasing said trip plunger to said plunger open position.

22. A low dissipation compact circuit breaker for selectively conducting breaker current in a circuit to be protected comprising:

an enclosure;

a stationary contact and a movable contact which selectively assume one of two bistable states, a contiguous closed state conducting breaker current, and a noncontiguous open state preventing conduction of breaker current;

a rotary operator means for selectively causing said stationary contact and said movable contact to assume one of said closed and open states, said rotary operator means includes a plurality of shaft rotary members on an operating shaft in a first direction; and a contact lever train rotating in a second direction;

a sensing trip means for sensing breaker current, for causing said rotary operation means to move said contacts from said closed state to said open state, and for directly acting to cause said contacts to begin to assume said open state in a trip operation, if said breaker current reaches a preselected trip value;

said rotary operator means when causing said contacts to move from a closed to an open position does so by initiating a trip operation;

further including trip energy storage means for storing and supplying energy to open said contacts of said breaker; and wherein said contact lever train is connected among a contact carrier and said shaft rotary members and said energy storage means; said trip energy storage means includes a trip spring;

a trip lunger which reciprocates between an open position corresponding to said open position of said contacts and a plunger closed position corresponding to said closed position of said contacts; and said trip spring biasing said trip plunger to said plunger open position;

said contact lever train includes a trip latch having a short lever arm operatively connected to said shaft rotary members and said trip energy storage means, and a longer lever arm operatively connected to a solenoid actuated by said trip current, a trigger activated by said solenoid and positioning said trip latch against trip spring bias, said trip latch preventing movement of said plunger to the open position until said trigger releases said latch due to trip current.

23. The low dissipation compact circuit breaker of claim 22 wherein said contact lever train also includes a bell crank which is operatively connected to said contact carrier and said trip plunger to use the stored trip energy to move said contact carriers carrying said moveable contacts to an open position corresponding to said open state of said contacts.

24. The low dissipation compact circuit breaker of claim 23 wherein:

an on off disc in said shaft rotary members; and a trip lever in said contact lever train;

said one off disc interacting with said trip lever when said on off disc is rotated from a closed position toward an open position to cause said trigger to unlock said trip latch and allowing said contacts to open.

25. The low dissipation compact circuit breaker of claim 1 wherein:

said compact circuit breaker includes an escapement lever having an on hook; and said rotary operator means includes a plurality of shaft rotary members on an operating shaft, one of which members is a hook plate selectively engaging said on hook to maintain said contacts in a closed state and said operating shaft in a closed position.

26. The low dissipation compact circuit breaker of claim 25 wherein:

said hook plate includes an escapement hook which selectively engages said on hook.

27. The low dissipation compact circuit breaker of claim 25 including an escapement return spring selectively biasing said escapement lever against said hook plate; and wherein said hook plate includes an escapement hook which selectively engages said first on hook.

28. The low dissipation compact circuit breaker of claim 25 wherein said breaker further includes hook disengagement off means for causing said escapement first on hook to disengage said escapement hook allowing said operating shaft to assume an off position and said contacts to assume a noncontiguous open state.

29. The low dissipation compact circuit breaker of claim 28 wherein said hook disengagement off means includes:

an operating lug on said operating shaft; and further including an operating disc mounted generally concentrically on said shaft to which said hook plate is pivotally mounted;

said hook plate defining a central aperture having an operating lug surface engageable by said operating lug to release said hook plate and associated rotary members and allowing said contacts to assume said open position and said shaft to assume said off position.

30. The low dissipation compact circuit breaker of claim 25 wherein said hook plate includes an escapement hook; and said escapement lever has a second trip hook which engages said escapement hook as a result of a trip operation allowing said operating shaft to rotate to a trip position where said shaft is positioned by said escapement hook and said second trip hook, and said contacts to assume said open state.

31. The low dissipation compact circuit breaker of claim 25 wherein:

said operating shaft is maintained in one of three positions, an on position when the contacts are closed, an off position when the contacts are open following an operator rotating the shaft, and a trip position following a trip level breaker current which opened said contacts.

32. The low dissipation compact circuit breaker of claim 31 further including position indicator means for indicating the position of said breaker among on, tripped, and off positions.

33. The low dissipation compact circuit breaker of claim 32 wherein said position indicator means includes:

said operator shaft extending through an enclosure front wall to an exterior knob end; and an elongate operator knob connected to said exterior end, the orientation of said operator knob indicating that said breaker is in one of said on, tripped or off positions.

34. The low dissipation compact circuit breaker of claim 33 wherein the orientation of said knob for the tripped positions is between said orientations for said on and off states.

35. The low dissipation compact circuit breaker of claim 34 further including:

a trip plunger released by said sensing means which in turn releases said first on hook from said escapement hook allowing said operating shaft and said hook plate to rotate to the tripped position where said shaft and said plate are positioned by the engagement of said escapement hook and said second trip hook.

36. The low dissipation compact circuit breaker of claim 35 further including:

hook disengagement reset means for causing said escapement second trip hook to disengage said escapement hook and allow said shaft to assume an off position.

37. The low dissipation compact circuit breaker of claim 36 wherein said disengagement means between said escapement hook and said second trip hook uses the same mechanism as said hook disengagement off means but said shaft begins from a different position and said contacts are already in said open state.

38. A low dissipation compact circuit breaker for selectively conducting breaker current in a circuit to be protected comprising:

an enclosure;

a stationary contact and a movable contact which selectively assume one of two bistable states, a contiguous closed state conducting breaker current, and a noncontiguous open state preventing conduction of breaker current;

a rotary operator means for selectively causing said stationary contact and said movable contact to assume one of said closed and open states;

a sensing trip means for sensing breaker current, for causing said rotary operation means to move said contacts from said closed state to said open state, and for directly acting to cause said contacts to being to assume said open state in a trip operation, if said breaker current reaches a preselected trip value;

said rotary operator means if causing said contacts to move from a closed to an open position does so by initiating a trip operation;

said circuit breaker includes an escapement lever having a on hook; and said rotary operator means includes a plurality of shaft rotary members on an operating shaft, one of which members is a hook plate selectively engaging said on hook to maintain said contacts in a closed state and said operating shaft in a closed position;

said operating shaft is maintained in one of three positions, a on position if the contacts are closed, an off position if the contacts are open following an operator rotating shaft, and a trip position following a trip level breaker current which opened said contacts;

position indicator means for indicating the position of said breaker among on, tripped, and off positions including said operator shaft extending through an enclosure front wall to an exterior knob end; and an elongate operator knob connected to said exterior end, the orientation of said operator knob indicating that said breaker is in one of said one, tripped or off positions a trip plunger released by said sensing means which in turn releases said on hook from said escapement hook allowing said operating shaft and said hook plate to rotate to the tripped position where said shaft and said plate are positioned by the engagement of said escapement hook and said trip hook;

hook disengagement reset means for causing said escapement trip hook to disengage said escapement hook and allow said shaft to assume an off position;

said disengagement means between said escapement hook and said trip hook uses the same mechanism as said hook disengagement off means but said shaft begins from a different position and said contacts are already in said open state;

said hook disengagement reset means includes an operating lug on said operating shaft;

and further including an operating disc mounted generally concentrically on said shaft to which said hook plate is pivotally mounted;

said hook plate defining a central aperture having an operating lug surface engageable by said operating lug to release said hook plate and associated rotary members and allowing said operating shaft to assume said open position.

39. The low dissipation compact circuit breaker of claim 35 further including:

an on off cam which releases said trip plunger when said shaft is rotated towards an off position only after said shaft has rotated said escapement hook beyond said second trip hook.

40. The low dissipation compact circuit breaker of claim 1 including a contact status means for indicating the state of the breaker actuated by the position of said contacts.

41. The low dissipation compact circuit breaker of claim 40 wherein said contact status means includes:

a viewing window in the front of said enclosure; and said breaker includes a trip plunger assuming one of two bistable states, an on state and an off state and having two state symbols on a surface of said plunger, only one of said symbols viewable through said viewing window at a time, the viewable symbol corresponding to the state of said breaker contacts.

42. The low dissipation compact circuit breaker of claim 19 further including reset hold means for positively inhibiting the closing of contacts when they are in the open position without substantial rotation of said operating shaft.

43. The low dissipation compact circuit breaker of claim 42 further including reset turn on means for allowing said contacts to be moved from said open position to said closed position by rotating said operating shaft.

44. A low dissipation compact circuit breaker for selectively conducting breaker current in a circuit to be protected comprising:

an enclosure;

a stationary contact and a movable contact which selectively assume one of two bistable state, a contiguous closed state conducting breaker current, and a noncontiguous open state preventing conduction of breaker current;

a rotary operator means for selectively causing said stationary contact and said movable contact to assume one of said closed and open states;

a sensing trip means for sensing breaker circuit, for causing said rotary operation means to move said contacts from said closed state to said open state, and for directly acting to cause said contacts to begin to assume said open state in a trip operation, if said breaker current reaches a preselected trip value;

said rotary operator means if causing said contacts to move from a closed to an open position does so by initiating a trip operation;

said rotary operator means includes a plurality of shaft rotary members on an operating shaft in a first direction ; and contact lever train rotating in a second direction;

reset hold means for positively inhibiting the closing of contacts if they are in the open position without substantial rotation of said operating shaft;

reset turn on means for allowing said contacts to be moved from said open position to said closed position by rotating said operating shaft;

said reset turn on means and said reset hold means are combined into a reset lever means for inhibiting undesired movement of said contacts to the closed position and for enabling moving said contacts to the closed position.

45. The low dissipation compact circuit breaker of claim 44 wherein said reset lever means includes a reset lever operationally connected to said rotary operator means, and to said contact lever train to selectively inhibit moving said contacts to a closed position, said lever biased to inhibit said contacts from moving to said closed position, and said lever selectively enabling moving said contacts to a closed position.

46. The low dissipation compact circuit breaker of claim 45 further including a bell crank in said contact lever train which is blocked by said reset lever to prevent movement of said contacts to said closed position; and a reset actuator being one of said shaft rotary members enabled by said reset lever to allow said contacts to move to said closed position.

47. The low dissipation compact circuit breaker of claim 46 further including:

a trip plunger including trip springs to store energy to move said contacts from a closed to an open position, said plunger having a closed plunger position and a open plunger position corresponding to said closed and open positions of said contacts;

said reset actuator including a lever abutment surface;

an expander including a reset surface pivotally mounted on said reset actuator; said lever engagement surface selectively engaged by said reset lever to prevent rotation of said reset actuator, said reset surface of said expander engaged by a rotary member as said lever actuator is prevented from rotation, causing said expander to move radially outward and engage an expander surface of said trip plunger, which on further rotation of said operating shaft moves said trip plunger to said open position.

48. The low dissipation compact circuit breaker of claim 1 further including:

a reset lever operationally connected to said rotary operator means, and to said contact lever train to selectively enabling moving said contacts to a closed position.

49. The low dissipation compact circuit breaker of claim 48 further including:

lockout means preventing enabling moving said contacts to a closed position.

50. A low dissipation compact circuit breaker of claim 49 wherein said lockout means includes: said rest lever; a lockout tab partially received within said enclosure, said lockout tab including a grip protruding outside said enclosure with an adjacent padlock hold, a medial ramp engaging in positioning said reset lever to prevent enabling moving said contacts to a closed position when said padlock hole is exposed. Said medium ramp providing a transition between a narrower height and a wider height of said tab; and a lockout bias spring tending to keep said lockout tab in a position or a wider portion of said lockout tab is disengaged from said reset lever.

51. The low dissipation compact circuit breaker of claim 1 further including;

a crank having an open position and a closed position corresponding to said contact open state and said closed state said crank including a crank state protuberance; and a crank state auxiliary switch actuated by said crank sate protuberance.

52. The low dissipation compact circuit breaker of claim 51 wherein said crank switch includes normally closed contacts; a spring biased crank switch actuator biased to close said normally closed contacts;

said crank switch actuator and said normally closed contacts spring mounted to avoid jamming said compact circuit breaker should said normally closed contacts weld.

53. The low dissipation compact circuit breaker of claim 52 wherein said crank state auxiliary switch can be used as a trip indicator changing state only when said breaker has reached an open state as a result of an overcurrent condition, said auxiliary switch being actuated by a trip switch actuator lever selectively interacting with a trip lever on the opposite side of said ball crank from said crank state protuberance.

54. The low dissipation compact circuit breaker of claim 49 wherein said lockout means preventing enabling moving said contacts to a closed position is engageable to prevent closure of the contacts whether said circuit breaker contacts are in an open or closed state, when said lockout means is engaged with said breaker contacts in a closed position, said lockout means prevents closing said contacts from a subsequent open state.

* * * * *